US010741145B2

(12) United States Patent
Koo et al.

(10) Patent No.: US 10,741,145 B2
(45) Date of Patent: Aug. 11, 2020

(54) DISPLAY APPARATUS AND DISPLAY METHOD

(71) Applicant: SAMSUNG ELECTRONICS CO., LTD., Suwon-si, Gyeonggi-do (KR)

(72) Inventors: Ki-hyeok Koo, Suwon-si (KR); Hyun-su Kim, Seoul (KR); Sin-wook Lee, Seoul (KR); Cheul-hee Hahm, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 421 days.

(21) Appl. No.: 15/215,827

(22) Filed: Jul. 21, 2016

(65) Prior Publication Data

US 2017/0025094 A1 Jan. 26, 2017

(30) Foreign Application Priority Data

Jul. 24, 2015 (KR) ..... 10-2015-0105291

(51) Int. Cl.
*G09G 5/10* (2006.01)
*G09G 3/3208* (2016.01)
*G09G 5/391* (2006.01)

(52) U.S. Cl.
CPC ..... *G09G 5/10* (2013.01); *G09G 3/3208* (2013.01); *G09G 5/391* (2013.01);
(Continued)

(58) Field of Classification Search
CPC ..... G09G 5/10; G09G 5/391; G09G 3/3208; G09G 2330/023; G09G 2320/08;
(Continued)

(56) References Cited

U.S. PATENT DOCUMENTS 8,299,985 B2 10/2012 Shin et al.
2001/0020989 A1* 9/2001 Nakayama ..... G02F 1/1336 349/61

(Continued)

FOREIGN PATENT DOCUMENTS

CN 1399458 A 2/2003
CN 101308626 A 11/2008

(Continued)

OTHER PUBLICATIONS

Search Report and Written Opinion dated Nov. 2, 2016 in counterpart International Patent Application No. PCT/KR2016/007898.

(Continued)

*Primary Examiner* — Kent W Chang
*Assistant Examiner* — Andrew Lee
(74) *Attorney, Agent, or Firm* — Nixon & Vanderhye P.C.

(57) ABSTRACT

A display apparatus and a display method are provided. The display apparatus includes a display comprising one or more light emitting element groups each group comprising a predetermined number of light emitting devices; and a controller configured to determine priorities of the light emitting elements included in the one or more light emitting element groups based on a collected light emitting time of each of the light emitting elements and to determine, based on the priorities, whether each of the light emitting elements emits light.

18 Claims, 16 Drawing Sheets

(52) U.S. Cl.
CPC ..... *G09G 2300/0452* (2013.01); *G09G 2320/0626* (2013.01); *G09G 2320/08* (2013.01); *G09G 2330/023* (2013.01); *G09G 2360/145* (2013.01)

(58) Field of Classification Search
CPC ... G09G 2320/0626; G09G 2300/0452; G09G 2360/145
See application file for complete search history.

(56) References Cited

U.S. PATENT DOCUMENTS

| | | | | |
|---|---|---|---|---|
| 2007/0045430 | A1* | 3/2007 | Chapman, Jr. ..... | G05D 23/1902 236/46 C |
| 2008/0258637 | A1 | 10/2008 | Leung | |
| 2009/0147032 | A1* | 6/2009 | Kim ..... | G09G 3/3225 345/690 |
| 2010/0110112 | A1 | 5/2010 | Nakanishi | |
| 2012/0169574 | A1 | 7/2012 | Kim | |
| 2013/0063458 | A1 | 3/2013 | Shido et al. | |
| 2014/0253581 | A1* | 9/2014 | Nobori ..... | G09G 5/10 345/590 |
| 2014/0368525 | A1* | 12/2014 | Faaborg ..... | G09G 5/02 345/589 |
| 2015/0130850 | A1 | 5/2015 | Wyatt | |
| 2015/0130863 | A1 | 5/2015 | Santo | |

FOREIGN PATENT DOCUMENTS

| | | | |
|---|---|---|---|
| CN | 101373575 | A | 2/2009 |
| CN | 103198790 | A | 7/2013 |
| CN | 103514832 | A | 1/2014 |
| JP | 2003-029709 | A | 1/2003 |
| JP | 2007-206464 | | 8/2007 |
| KR | 10-2003-0065028 | | 8/2003 |
| KR | 10-2009-0013985 | | 2/2009 |
| KR | 10-2012-0079610 | | 7/2013 |

OTHER PUBLICATIONS

Chinese Office Action dated Nov. 28, 2019 for CN Application No. 201680038007.X.

* cited by examiner

DISPLAY APPARATUS AND DISPLAY METHOD

CROSS-REFERENCE TO RELATED APPLICATION

This application is based on and claims priority under 35 U.S.C. § 119 to Korean Patent Application No. 10-2015-0105291, filed on Jul. 24, 2015, in the Korean Intellectual Property Office, the disclosure of which is incorporated by reference herein in its entirety.

BACKGROUND

1. Field

The present disclosure relates to display apparatuses and display methods, and for example, to display apparatuses capable of controlling light emitting elements of a display and display methods thereof.

2. Description of Related Art

Display apparatuses are apparatuses having a function of providing an image to a user. Display apparatuses also provide various functions for user convenience along with the function of providing the image. As display apparatuses provide a high resolution image and increase functions for user convenience, display apparatuses consume a significant amount of power. In particular, mobile display apparatuses such as smart phones, tablet personal computers (PCs), laptop computers, etc. and large size display apparatuses use various technologies for reducing the amount of power consumed.

Meanwhile, a display may include at least one of a liquid crystal display (LCD), a thin film transistor-liquid crystal display (TFT-LCD), an organic light-emitting diode (OLED), a plasma display panel (PDP), and a quantum dot light-emitting diode (QLED).

The OLED and the QLED may display colors by using a self light emitting phenomenon whereby light is emitted when current flows in a phosphorus organic compound. In particular, when the OLED is used, if a specific screen is driven for a long time in a fixed state, brightness of a display screen may be reduced due to deterioration of a part of a light emitting device.

SUMMARY

Display apparatuses that control light emitting elements to individually emit light or not to emit light, thereby reducing power consumption are provided.

Display apparatuses that control some light emitting devices, which have a long accumulated light emitting time, to not emit light, thereby increasing an average lifespan of light emitting elements included in a display apparatus are provided.

Additional aspects will be set forth in part in the description which follows and, in part, will be apparent from the description.

According to an aspect of an example embodiment, a display apparatus includes: a display including one or more light emitting element groups each group including a predetermined number of light emitting devices; and a controller configured to determine priorities of the light emitting elements included in the one or more light emitting element groups based on a collected light emitting time of each of the light emitting elements and to determine, based on the priorities, whether each of the light emitting elements emits light.

The controller may be further configured to determine, based on the priorities, the number and brightness of the light emitting elements that emit light.

The controller may be further configured to determine whether a light emitting element having a longest collected light emitting time among the light emitting elements does not emit light.

The controller may be further configured to change whether each of the light emitting elements emits light at a time when content displayed on the display is changed.

The display apparatus may further include: a memory configured to store the collected light emitting time of each of the light emitting devices, wherein the controller is further configured to update the collected light emitting time of each of the light emitting elements if it is changed based on whether each of the light emitting elements emits light.

The display may be further configured to display a user interface for selecting at least one of the number and brightness of the light emitting elements included in the one or more light emitting element groups that emit light.

The display apparatus may further include: a light sensor configured to sense an amount of light, wherein the controller is further configured to select one of a first mode in which all the light emitting elements emit light and a second mode in which some of the light emitting elements emit light, based on the amount of light sensed by the light sensor.

The controller may be further configured to select the first mode when the light sensor senses that the amount of light is less than a preset amount of light.

The controller may be further configured to select the second mode when the light sensor senses that the amount of light is greater than a preset amount of light.

The controller may be further configured to determine whether each of the light emitting elements emits light in a same way when a screen displayed on the display includes text.

The controller may be further configured to composite an alpha image and output image data based on whether each of the light emitting elements emit light.

According to an aspect of another example embodiment, a display method performed by a display apparatus including a display including one or more light emitting element groups each group including a predetermined number of light emitting devices, the display method including determining priorities of the light emitting elements included in the one or more light emitting element groups based on a collected light emitting time of each of the determined number of light emitting devices; and determining, based on the priorities, whether each of the light emitting elements emits light.

The determining may include: determining, based on the priorities, the number and brightness of the light emitting elements that emit light.

The determining may include: determining whether a light emitting element having a longest collected light emitting time among the light emitting elements does not emit light.

The display method may further include: changing whether each of the light emitting elements emits light when content displayed on the display is changed.

The display method may further include: updating the collected light emitting time of each of the light emitting elements based on a change in whether each of the light emitting elements emits light.

The display method may further include: displaying a user interface for selecting at least one of the number and brightness of the light emitting elements included in the one or more light emitting element groups that emit light.

The display method may further include: selecting one of a first mode, in which all the light emitting elements emit light and a second mode in which some of the light emitting elements emit light, based on an amount of light sensed by a light sensor.

The display method may further include: selecting the first mode when the light sensor senses that the amount of light is less than a preset amount of light.

The display method may further include: selecting the second mode when the light sensor senses that the amount of light is greater than a preset amount of light.

The display method may further include: determining whether each of the light emitting elements emits light in a same way when a screen displayed on the display includes text.

The display method may further include: compositing an alpha image and outputting image data based on whether each of the light emitting elements emit light.

BRIEF DESCRIPTION OF THE DRAWINGS

These and/or other aspects will become apparent and more readily appreciated from the following detailed description, taken in conjunction with the accompanying drawings, in which like reference numeral refer to like elements, and wherein.

DETAILED DESCRIPTION

Figure 1:
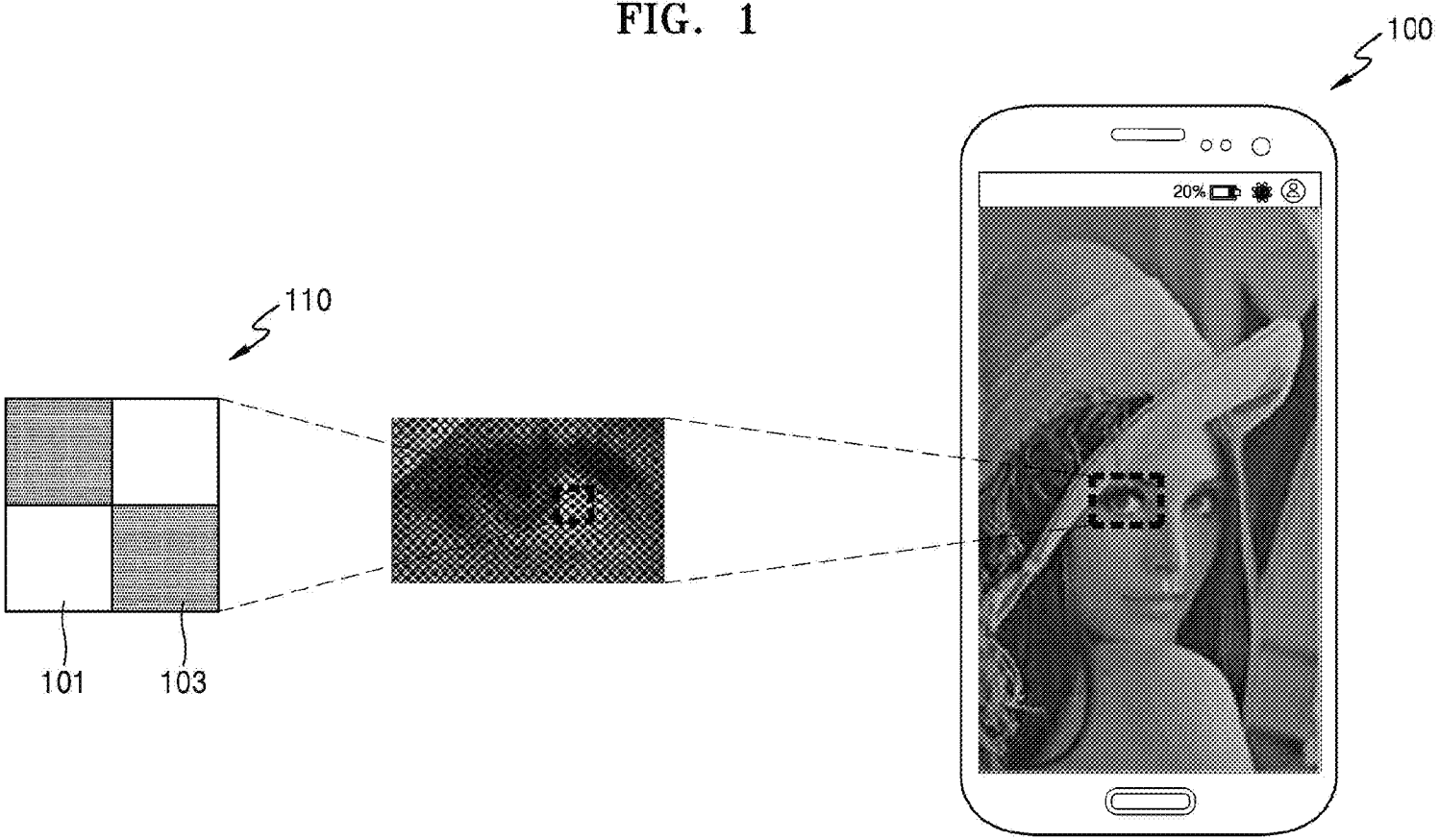
FIG. 1 is a diagram illustrating an example display apparatus according to an example embodiment.

Embodiments will be described more fully hereinafter with reference to the accompanying drawings. A method of configuring and using a display apparatus according to example embodiments will be described more fully hereinafter with reference to the accompanying drawings. The same reference numerals in the drawings denote the same components or elements that perform the same functions.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of embodiments. As used herein, the term "and/or" includes any and all combinations of one or more of the associated listed items. Expressions such as "at least one of," when preceding a list of elements, modify the entire list of elements and do not modify the individual elements of the list.

The terminology used herein is for the purpose of describing example embodiments only and is not intended to be limiting of the example embodiments. As used herein, the singular forms "a", "an", and "the" are intended to include the plural forms as well, unless the context clearly indicates otherwise. It will be further understood that the terms "comprises", "comprising", "includes", and/or "including", when used herein, specify the presence of stated features, integers, steps, operations, elements, components, and/or groups thereof but do not preclude the presence or addition of one or more other features, integers, steps, operations, elements, components, and/or groups thereof.

In the description, the term "display" may indicate a component having a function of visually outputting image data. Also, when a display panel and a touch pad included in a display have a layer structure to configure a touch screen according to an implementation example, the display may also be used as an input apparatus besides an output apparatus. The display may include at least one of a liquid crystal display (LCD), a thin film transistor-liquid crystal display (TFT-LCD), an organic light-emitting diode (OLED), a flexible display, a three-dimensional (3D) display, an electrophoretic display, and a plasma display panel (PDP).

FIG. 1 is a diagram illustrating an example display apparatus 100 according to an example embodiment.

The display apparatus 100 is an apparatus that visually displays image data.

As illustrated in FIG. 1, the display apparatus 100 may include a portable terminal such as a smart phone, a tablet, etc. The display apparatus 100 may also include a display apparatus of not only a shown shape but also various shapes. For example, the display apparatus 100 may include a personal computer (PC) monitor, a television (TV) monitor, etc. and may also include a commercial large format display (LFD).

According to an example embodiment, a display panel included in the display apparatus 100 may be implemented as an OLED and a quantum dot LED (QLED). The OLED and the QLED may display colors by using a self light emitting phenomenon whereby light is emitted when current flows in a phosphorus organic compound. The OLED and the QLED themselves may emit light without a back light unit, unlike a liquid crystal display (LCD).

Meanwhile, the display apparatus 10 may include a plurality of light emitting elements for displaying image data. The plurality of light emitting elements may be arranged in a matrix shape. The light emitting elements of the display apparatus 100 may be implemented as the OLED and the QLED. When the light emitting elements are implemented as the OLED and the QLED, the display apparatus 100 may control the light emitting elements to individually emit light.

A case where the plurality of light emitting elements included in the display apparatus 100 according to an example embodiment are individually controlled will now be described below.

According to an example embodiment, the display apparatus 100 may include one or more light emitting element groups 110. Each of the light emitting element groups 110 may include a previously determined number of light emitting devices.

For example, each of the light emitting element groups 110 may include a plurality of light emitting elements configured, for example, in an N*N matrix. Referring to FIG. 1, the light emitting element group 110 may be configured in 2*2 and may include four light emitting devices. The light emitting element groups 110 shown in FIG. 1 is merely an example and may be configured in various shapes such as 3*3, 2*4, etc.

The display apparatus 100 may determine priorities of the light emitting elements included in the light emitting element group 110 based on a collected light emitting time of each of the light emitting devices.

In this regard, the collected light emitting time of a light emitting element may refer, for example, a total sum of time that the light emitting element emits light after the display apparatus 100 is manufactured. The collected light emitting time of each of the light emitting elements may be stored in a memory (not shown) included in the display apparatus 100.

Priority may be a reference for selecting some devices that are to emit light when the display apparatus 100 emits some of the light emitting elements included in the light emitting element group 110. More specifically, the display apparatus 100 may determine priority of a light emitting element having a shortest collected light emitting time as first priority. The display apparatus 100 may determine priority of a light emitting element having a longest collected light emitting time as a lowest priority.

The display apparatus 100 may determine whether each of the light emitting elements emits light based on the determined priorities.

For example, the display apparatus 100 may determine that a light emitting element 101 having a highest priority in the light emitting element group 110 emits light. The display apparatus 100 may determine that a light emitting element 103 having a lowest priority in the light emitting element group 110 does not emit light. The display apparatus 100 may determine that two or more light emitting elements in the light emitting element group 110 emit light in high priority sequence. According to an example embodiment shown in FIG. 1, the display apparatus 100 may determine that two light emitting elements in the light emitting element group 110 including the four light emitting elements emit light in high priority sequence.

Meanwhile, referring to FIG. 1, although locations of the light emitting elements that emit light in a plurality of light emitting element groups are the same, the display apparatus 100 may differently set locations of the light emitting elements that emit light for each of the plurality of light emitting element groups.

The display apparatus 100 may control the light emitting elements to individually emit light or not emit light, thereby reducing power consumption. The display apparatus 100 may also control some of the light emitting elements having a long collected light emitting time not to emit light, thereby increasing an average lifespan of the light emitting elements included in the display apparatus 100.

Figure 2:
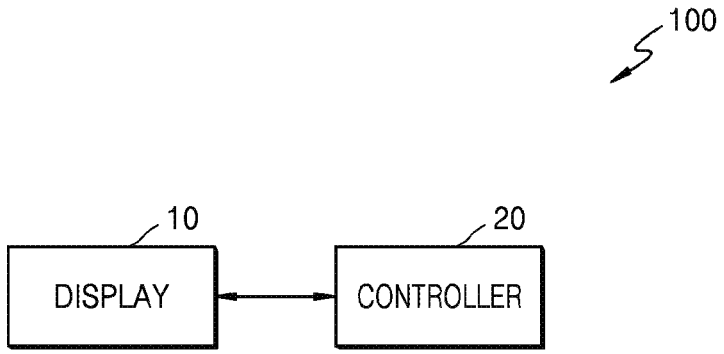
FIG. 2 is a block diagram illustrating an example display apparatus according to an example embodiment.

FIG. 2 is a block diagram illustrating an example of display apparatus 100 according to an example embodiment.

Referring to FIG. 2, the display apparatus 100 may include, for example, a display 10 and a controller 20.

The display 10 according to an example embodiment may include one or more light emitting element groups. Each light emitting element group may include a previously determined number of light emitting devices. A display panel included in the display 10 according to an example embodiment may be implemented as an OLED, a QLED, etc.

The display 10 according to an example embodiment may display a user interface for selecting at least one of the number of light emitting elements that emit light in the light emitting element groups and brightness of each of the light emitting elements that emit light.

According to an example embodiment, a user may personally select the number of light emitting elements that emit light in the light emitting element groups of the display apparatus 100 and the brightness of each of the light emitting elements that emits light through the user interface.

According to another example embodiment, when the display apparatus 100 is set as a power saving mode, the number of light emitting elements that emit light in the light emitting element groups of the display apparatus 100 and the brightness of each of the light emitting elements that emits light may be automatically adjusted.

The controller 20 according to an example embodiment may determine priorities of the light emitting elements included in the light emitting element groups based on a collected light emitting time of each of the light emitting elements and may determine whether each of the light emitting elements emits light based on the priorities.

The controller 20 according to an example embodiment may determine that a light emitting element having a longest collected light emitting time among the light emitting elements does not emit light. The controller 20 may determine that a previously determined number of light emitting elements emit light in high priority order in the light emitting element groups.

The controller 20 according to an example embodiment may adjust the number of light emitting elements that emit light and brightness of each of the light emitting elements based on the determined priorities.

The controller 20 according to an example embodiment may change whether each of the light emitting elements emits light at a time when content displayed on the display 10 is changed. For example, the controller 20 may change whether each of the light emitting elements emits light at a time when an application executed by the display apparatus 100 is changed. The controller 20 may change whether each of the light emitting elements emits light at a time when a channel broadcasted by the display apparatus 100 is changed to another channel. The controller 20 may also change whether each of the light emitting elements emits light at a time when the display 10 of the display apparatus 100 is turned off and then on.

According to another example embodiment, when the controller 20 may change whether each of the light emitting elements of the display 10 emits light at a certain time cycle, the light emitting elements that are turned on/off may be changed while the same image is displayed on the display 10. In this regard, the user may feel a sense of incompatibility since the image displayed on the display 10 is changed. However, according to an example embodiment, when the controller 20 changes whether each of the light emitting elements emits light at the time when the content displayed on the display 10 is changed, the user may not fee the sense of incompatibility and may feel that a screen naturally changes.

The controller 20 according to an example embodiment may update the collected light emitting time of each of the light emitting elements if it is changed whether each of the light emitting elements emits light. The collected light emitting time of each of the light emitting elements may be stored in a memory (not shown) included in the display apparatus 100.

The controller 20 according to an example embodiment may select one of a first mode in which all the light emitting elements emit light and a second mode in which some of the light emitting elements emit light.

In this regard, the first mode may refer, for example, to a mode in which only brightness may be changed while all the light emitting elements included in the light emitting element groups of the display apparatus 100 emit light. The second mode may refer, for example, to a mode in which only some of the light emitting elements included in the light emitting element groups of the display apparatus 100 emit light.

The display apparatus 100 may select one of the first mode and the second mode in a power saving mode to reduce power consumed by the display 10.

More specifically, according to an example embodiment, when the display apparatus 100 is set as the power saving mode, the display apparatus 100 may select the first mode to change brightness of all the light emitting elements included in the light emitting element groups of the display 10 to be lower than a highest brightness.

According to another embodiment, when the display apparatus 100 is set as the power saving mode, the display apparatus 100 may select the second mode to control a light emitting state of some of the light emitting elements included in the light emitting element groups of the display 10 as an off state. According to an example embodiment, the controller 20 may change brightness of some of the light emitting elements that emit light to be lower than the highest brightness in the second mode.

Meanwhile, the display apparatus 100 may further include a light sensor (not shown) that recognizes an amount of light. The controller 20 according to an example embodiment may select one of one of the first mode in which all the light emitting elements emit light and the second mode in which some of the light emitting elements emit light based on the amount of light recognized by the light sensor.

More specifically, when the light sensor recognizes an amount of light smaller than a previously determined amount of light, the controller 20 according to an example embodiment may select the first mode. That is, when brightness around the display apparatus 100 is dark, the controller 20 may select the first mode. When the light sensor recognizes an amount of light greater than the previously determined amount of light, the controller 20 according to an example embodiment may select the second mode. That is, when brightness around the display apparatus 100 is bright, the controller 20 may select the second mode.

For example, according to an example embodiment, an amount of light smaller than an amount of light previously determined in the display apparatus 100 may be recognized. In this case, since brightness around the display apparatus 100 is relatively dark, although brightness of the light emitting elements of the display 10 is adjusted as 50% of the highest brightness, the user may identify colors displayed on the display apparatus 100. According to an example embodiment, when the amount of light smaller than the amount of light previously determined in the display apparatus 100 is recognized, the display apparatus 100 may adjust brightness of all the light emitting elements as 50% of the highest brightness according to the first mode.

As another example, according to an example embodiment, an amount of light greater than the amount of light previously determined in the display apparatus 100 may be recognized. In this case, since brightness around the display apparatus 100 is relatively bright, if brightness of the light emitting elements of the display 10 is adjusted as 50% of the highest brightness, the user may not identify colors displayed on the display apparatus 100. According to an example embodiment, when the amount of light greater than the amount of light previously determined in the display apparatus 100 is recognized, the display apparatus 100 may control a light emitting state of some of the light emitting elements as an off state according to the second mode.

The controller 20 according to an example embodiment may determine whether a screen displayed on the display 10 includes text. When it is determined that the screen displayed on the display 10 includes text, the controller 20 according to an example embodiment may determine whether each of the light emitting elements emits light in the same manner. That is, when the screen displayed on the display 10 includes text, if some of the light emitting elements do not emit, since the user of the display apparatus 100 does not exactly recognize text, the controller 20 may determine that all the light emitting elements emit light.

The controller 20 according to example an embodiment may control the screen of the display 10 to be displayed based on whether each of the light emitting elements emits light.

More specifically, the controller 20 according to an example embodiment may control a display driver IC (not shown) included in the display 10 based on whether each of the light emitting elements emits light. The display driver IC may include an integrated circuit for driving the display 10. That is, the controller 20 may directly control the display 10 through the display driver IC.

The controller 20 according to an example embodiment may composite an alpha image and output image data based on whether each of the light emitting elements emits light. A graphic processing unit (GPU) included in the controller 20 may composite the alpha image and the output image data.

According to an example embodiment, the alpha image may be an image indicating which light emitting element is displayed and which light emitting element is not displayed. The controller 20 may generate the alpha image based on a determined priority. The display apparatus 100 may store the output image data in a frame buffer (not shown). The frame buffer may be a separate memory that temporarily stores image data that is to appear on the screen of the display 10 and is included in the display 100.

More specifically, the controller 20 may generate the alpha image indicating that a light emitting element that is to be displayed is made transparent and a light emitting element that is not to be displayed is made black based on whether each of the light emitting elements emits light.

Meanwhile, the display apparatus 100 may be connected to a desk top, a laptop, a tablet PC, a camera, a cellular phone, a storage medium, and other electronic devices to receive image data wirelessly or by wired. According to an implementation, the display apparatus 100 may receive an analog broadcast signal or a digital broadcast signal. The display apparatus 100 may be implemented as a flat display apparatus, a curved display apparatus having a curvature, or a flexible display apparatus having an adjustable curvature. The display apparatus 100 may include two or more displays according to an implementation shape.

Figure 3:
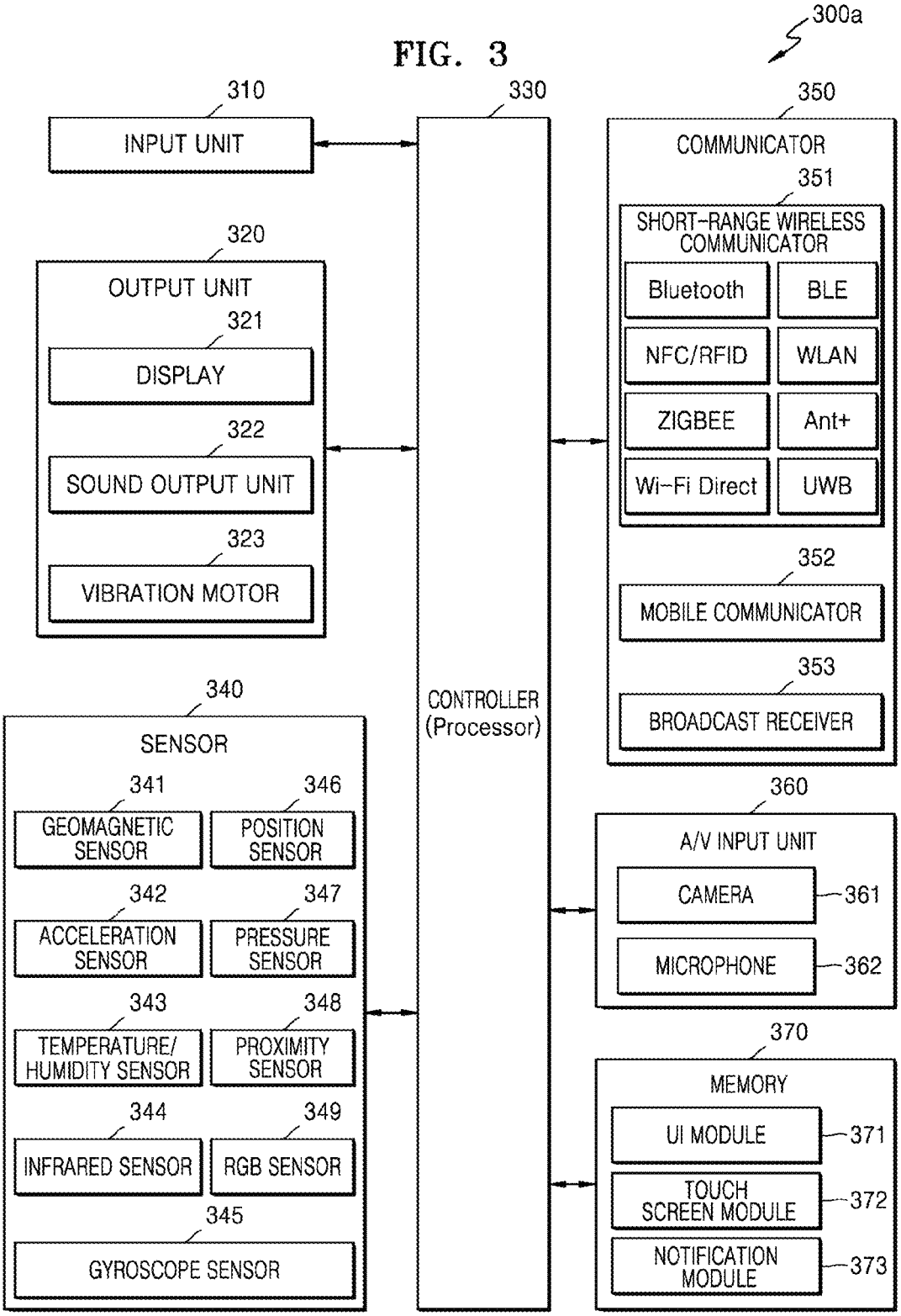
FIG. 3 is a block diagram illustrating an example portable terminal related to an example embodiment.

FIG. 3 is a block diagram illustrating an example portable terminal 300*a* to which a display apparatus is to be applied according to an example embodiment.

The portable terminal 300*a* according to an example embodiment may include a portable electronic apparatus such as a smart phone, a tablet, etc.

As shown in FIG. 3, the portable terminal 300*a* according to an example embodiment may include an input unit (e.g., including input circuitry) 310, an output unit (e.g., including output circuitry) 320, a controller 330, a sensor 340, a communicator (e.g., including communication circuitry) 350, an A/V input unit (e.g., including A/V input circuitry) 360, and a memory 370.

The input unit 310 may refer, for example, a unit including circuitry for a user to input data for controlling the portable terminal 300*a*. For example, the user input unit 310 may include a key pad, a dome switch, a touch pad (a contact capacitance type, a pressure resistive film type, an infrared ray detection type, a surface ultrasound conduction type, an integral tension measurement type, a piezoelectric effect type, etc.), a jog wheel, a jog switch, etc. but is not limited thereto.

The input unit 310 may be controlled by the controller 330 to receive a user input.

The output unit 320 may be controlled by the controller 330 to output an audio signal, a video signal, or a vibration signal and may include a display 321, a sound output unit 322, and a vibration motor 323.

The display 321 may include the display 10 described with reference to FIG. 2.

According to an example embodiment, the display 321 may include one or more light emitting element groups. Each light emitting element group may include a previously determine number of light emitting devices. According to an example embodiment, a display panel included in the display 321 may be implemented as an OLED and a QLED. Redundant descriptions between the display 321 of FIG. 3 and the display 10 described with reference to FIG. 2 are omitted.

Meanwhile, when the display 321 and a touch pad have a layer structure to configure a touch screen, the display 321 may be used as an input apparatus besides an output apparatus. The display 321 may include at least one of a liquid crystal display (LCD), a thin film transistor-liquid crystal display, an organic light-emitting diode (OLED), a flexible display, a three-dimensional (3D) display, and an electrophoretic display. The portable terminal 300*a* may include two or more displays 321 according to an implementation shape. In this regard, the two or more displays 321 may be disposed to face each other by using a hinge.

The sound output unit 322 may output audio data that is received from the communicator 350 or stored in the memory 370. The sound output unit 322 may output a sound signal related to a function (e.g., a call signal receiving sound, a message receiving sound, and an alarm sound) performed in the portable terminal 300*a*. The sound output unit 322 may include a speaker, a buzzer, etc.

The vibration motor 323 may output a vibration signal. For example, the vibration motor 323 may output the vibration signal corresponding to an output of audio data or video data (e.g., a call signal receiving sound, a message receiving sound, etc.) The vibration motor 323 may also output the vibration signal when a touch is input onto the touch screen.

The controller 330 may usually control an overall operation of the portable terminal 300*a* and a signal flow between the elements 310 through 370 of the portable terminal 300*a* and may process data. For example, the controller 330 may execute programs stored in the memory 370 to control the user input unit 310, the output unit 320, the sensor 340, the communicator 350, the A/V input unit 360, etc. When a user input exists or a preset and stored condition is satisfied, the controller 330 may execute an operation system (OS) and various applications that are stored in the memory 370.

The controller 330 may include the controller 20 described with reference to FIG. 2.

According to an example embodiment, the controller 330 may determine priorities of light emitting elements included in the light emitting element groups based on a collected light emitting time of each of the light emitting elements and may determine whether each of the light emitting elements emits light based on the priorities. Redundant descriptions between the controller 330 of FIG. 3 and the controller 2 described with reference to FIG. 2 are omitted.

The sensor 340 may sense a state of the portable terminal 300*a* or a periphery state thereof and may transfer sensed information to the controller 330. The sensor 340 may include at least one selected from a magnetic sensor 341, an acceleration sensor 342, a temperature/humidity sensor 343, an infrared sensor 344, a gyroscope sensor 345, a position sensor 346 (e.g., a GPS), a pressure sensor 347, a proximity sensor 348, and an RGB illuminance sensor 349 but is not limited thereto. Functions of these sensors may be intuitively inferred from their names by one of ordinary skill in the art, and thus their detailed descriptions are omitted.

A light sensor included in the sensor 340 according to an example embodiment may sense an amount of light around the portable terminal 300*a*. The sensor 340 may include a sensor for sensing a touch input by an input tool and a sensor for sensing a touch input by a user. In this case, the sensor for sensing the touch input by the user may be included in a touch screen or a touch pad. The sensor for sensing the touch input by the input tool may be located in a lower portion of the touch screen or the touch pad or may be included in the touch screen or the touch pad.

The communicator 350 may include communication circuitry including one or more elements that allow communication between the portable terminal 300*a* and an external device or the portable terminal 300*a* and a server (not shown). For example, the communicator 350 may include a short-range wireless communicator 351, a mobile communicator 352, and a broadcast receiver 353.

The short-range wireless communicator 351 may include a Bluetooth communicator, a Bluetooth Low Energy (BLE) communicator, a near field communication (NFC) unit, a wireless LAN (Wi-FI) communicator, a Zigbee communicator, an Infrared Data Association (IrDA) communicator, a Wi-Fi Direct (WFD) communicator, an ultra-wideband (UWB) communicator, an Ant+ communicator, etc. but is not limited thereto.

The mobile communicator 352 may include communication circuitry configured to transmit and receive a wireless signal with at least one selected from a base station, an external terminal, and a server on a mobile communication network. In this regard, the wireless signal may include a voice call signal, a video call signal, or various types of data generated by transmitting and receiving or text/multimedia messages.

The broadcast receiver 353 may include circuitry configured to receive a broadcast signal and/or broadcast-related information from the outside through a broadcast channel. The broadcast channel may include a satellite channel and a terrestrial channel. The portable terminal 300*a* may not include the broadcast receiver 353 according to an implementation example.

An Audio/Video (A/V) input unit 360 may include circuitry configured to be used to input an audio signal or a video signal and may include a camera 361, a microphone 362, etc. The camera 361 may acquire an image frame, such as a still image, a moving image, etc., through an image sensor in a video call mode or a capturing mode. An image captured through the image sensor may be processed through the controller 330 or a separate image processor (not shown).

The image frame processed in the camera 361 may be stored in the memory 370 or may be transmitted to the outside through the communicator 350. Two or more cameras 361 may be included according to a configuration of the portable terminal 300*a*.

The microphone 362 may receive an external sound signal and process the external sound signal as voice data. For example, the microphone 362 may receive a sound signal from an external device or a speaker. The microphone 3623 may use various types of noise removing algorithms for removing noise generated in a process of receiving the external sound signal.

The memory 370 may store programs for processing and control of the controller 330 and store input and output data.

The memory 370 according to an example embodiment may store whether each of light emitting elements emit light based on priorities.

The memory 370 may include at least one type storage medium among a flash memory type, a hard disk type, a multimedia card micro type, a card type memory (e.g., an SD or XD memory, etc.), a random access memory (RAM), a static RAM (SRAM), a read only memory (ROM), an electrically erasable programmable ROM (EEPROM), a programmable ROM (PROM), a magnetic memory, a magnetic disk, and an optical disk. The portable terminal 300*a* may operate a web storage or a cloud server that performs a storage function of the memory 370 on the Internet.

Programs stored in the memory 370 may be classified into a plurality of modules according to their functions, for example, a user interface (UI) module 371, a touch screen module 372, a notification module 373, etc.

The UI module 371 may provide a UI, a graphical user interface (GUI), etc. that are specialized to interact with the portable terminal 300*a* according to applications. The touch screen module 372 may sense a touch gesture on a touch screen of a user and transmit information about the touch gesture to the controller 330. The touch screen module 372 according to an example embodiment may recognize and analyze a touch code. The touch screen module 372 may be configured as separate hardware including a controller.

The notification module 373 may generate a signal for notifying an event occurrence of the portable terminal 300*a*. Examples of an event occurring in the portable terminal 300*a* may include call signal receiving, message receiving, a key signal input, a schedule notification, etc. The notification module 373 may output a notification signal in a video signal form through the display 321, in an audio signal form through the sound output unit 322, or in a vibration signal form through the vibration motor 323.

Figure 4:
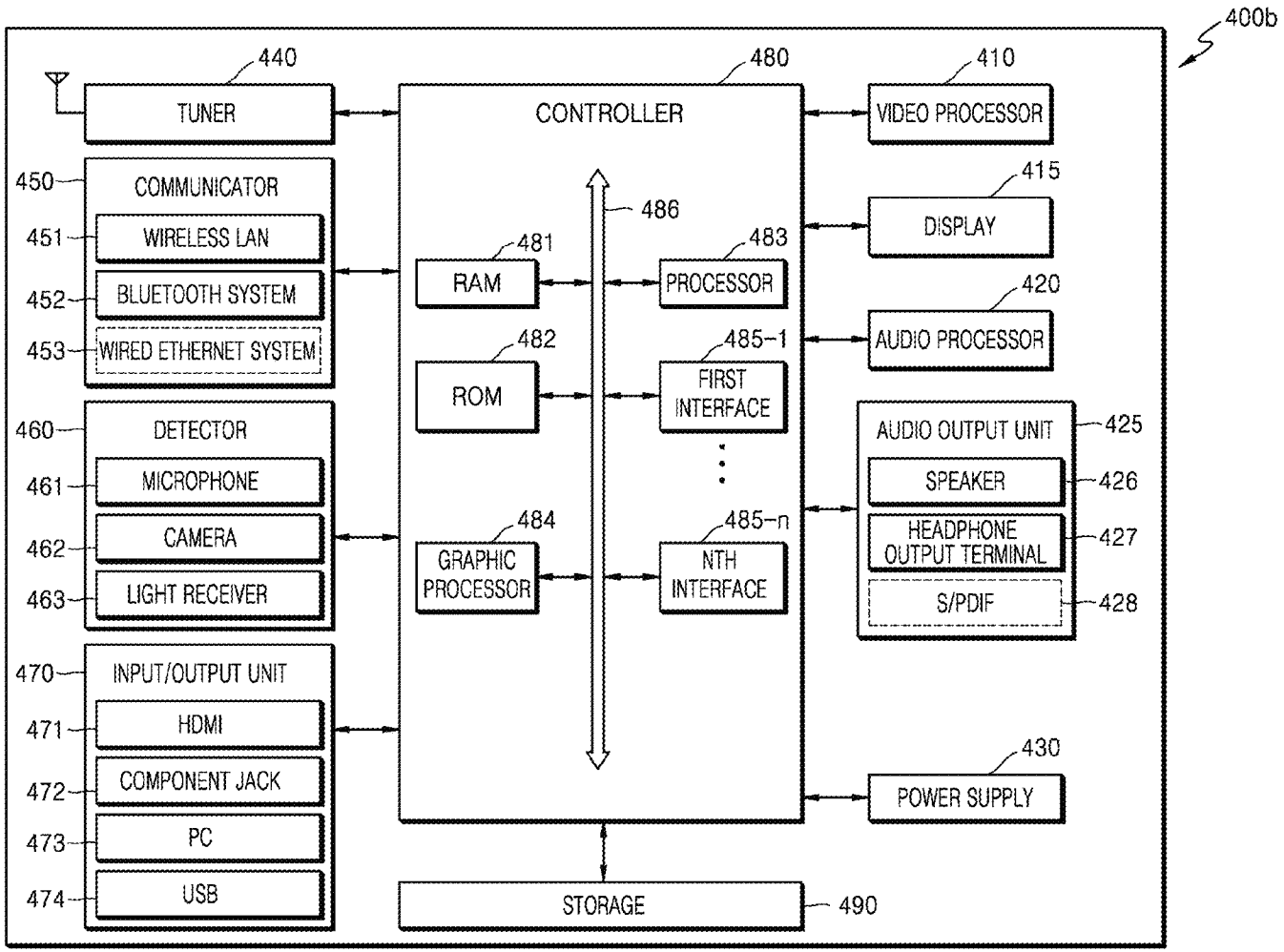
FIG. 4 is a block diagram illustrating an example display apparatus related to an example embodiment.

FIG. 4 is a block diagram illustrating an example display apparatus 400*b* related to an example embodiment.

The display apparatus 400*b* according to an example embodiment may include a commercial LFD, a PC monitor, a TV monitor, etc. The display apparatus 400*b* of FIG. 4 may include the display apparatus 100 according to an example embodiment described with reference to FIG. 2.

Referring to FIG. 4, the display apparatus 400*b* may include a video processor 410, a display 415, an audio processor 420, an audio output interface 425, a power supply 430, a tuner 140, a communicator (e.g., including communication circuitry) 450, a detector (e.g., including detection circuitry) 460, an input/output unit (e.g., including input/output circuitry0 470, a controller 480, and a storage 490.

The video processor 410 may process video data received by the display apparatus 400*b*. The video processor 410 may perform various image processing such as decoding, scaling, noise filtering, frame rate conversion, or resolution conversion on the video data.

The display 415 may display, on a screen, a video included in a broadcast signal received through the tuner 440 under control of the controller 480.

The display 415 may include the display 10 described with reference to FIG. 2. According to an example embodiment, the display 415 may include one or more light emitting element groups. Each light emitting element group may include a previously determine number of light emitting devices. According to an example embodiment, a display panel included in the display 415 may be implemented as an OLED and a QLED. Redundant descriptions between the display 415 of FIG. 4 and the display 10 described with reference to FIG. 2 are omitted.

The display 415 may display content (e.g., a moving image) input through the communicator 450 or the input/output unit 470 under control of the controller 480. The display 415 may output an image stored in the storage 490 under control of the controller 480. The display 115 may also display a voice user interface (UI) (e.g., including a voice command guide) for performing a voice recognition task corresponding to voice recognition, or a motion UI (e.g., including a user motion guide for motion recognition) for performing a motion recognition task corresponding to motion recognition.

The audio processor 420 may process audio data. The audio processor 420 may perform various processing such as decoding, amplification, or noise filtering on the audio data. The audio processor 420 may include a plurality of audio processing modules in order to process audio corresponding to a plurality of pieces of content.

The audio output unit 425 may output audio included in a broadcast signal received through the tuner 440 under control of the controller 480. The audio output unit 425 may output audio (e.g., voice or sound) input through the communicator 450 or the input/output unit 470. The audio output unit 425 may output audio stored in the storage 490 under control of the controller 480. The audio output unit 425 may include at least one of a speaker 426, a headphone output terminal 427, and a Sony/Philips digital interface (S/PDIF) output terminal 428. The audio output unit 425 may include a combination of the speaker 426, the headphone output terminal 427, and the S/PDIF output terminal 428.

The power supply 430 may supply power input from an external power supply source to elements (410 through 490) of the display apparatus 400*b* under control of the controller 480. The power supply 430 may supply power output from one or more batteries (not shown) provided in the display apparatus 400*b* to the elements (410 through 490) under control of the controller 480.

The tuner 440 may tune and select only a frequency of a channel to be received by the display apparatus 400*b* from electromagnetic waves components by performing amplification, mixing, or resonance on a broadcast signal received by wired or wirelessly. The broadcast signal may include audio, video, and additional information (e.g., an electronic program guide (EPG)).

The communicator 450 may include circuitry configured to connect the display apparatus 400*b* to an external apparatus (for example, an audio apparatus, etc.) under control of the controller 480. The controller 480 may transmit and receive content to and from the external apparatus connected through the communicator 450 and may download or web browse an application from the external apparatus. The communicator 450 may include various communication circuitry including one or more of a wireless local area network (LAN) 451, a Bluetooth system 452, and a wired Ethernet system 453 according to a performance and a structure of the display apparatus 400*b*. The communicator 450 may include a combination of the wireless LAN 451, the Bluetooth system 452, and the wired Ethernet system 453. The communicator 450 may receive a control signal of a control apparatus 200 under control of the controller 480. The control signal may be a Bluetooth signal, a radio frequency (RF) signal, or a WiFi signal. The communicator 450 may further include a short-range communication system (e.g., a NFC system (not shown) or a BLE system (not shown)) other than the Bluetooth system 452.

The detector 460 may include detection circuitry configured to detect a user's voice, image, or interaction.

The microphone 461 may receive user's uttered voice. The microphone 461 may convert the received voice into an electrical signal and may output the electrical signal to the controller 480. The user's voice may include, for example, voice corresponding to a menu or a function of the display apparatus 400*b*. A recommended recognition range of the microphone 461 may be about 4 m between the microphone 461 and a position of the user and may vary according to a user's voice tone and an ambient environment (e.g., a speaker sound or ambient noise).

The microphone 461 may be implemented integrally with or separately from the display apparatus 400*b*. The separated microphone 461 may be electrically connected to the display apparatus 400*b* through the communicator 450 or the input/output unit 470.

It will be understood by one of ordinary skill in the art that the microphone 461 may be omitted according to the performance and the structure of the display apparatus 400*b*.

The camera 462 may receive an image (e.g., continuous frames) corresponding to a motion of the user including a gesture within a camera recognition range. The camera 462 may be implemented integrally with or separately from the display apparatus 400*b*. A separate apparatus (not shown) including the separated camera 462 may be electrically connected to the display apparatus 400*b* through the communicator 450 or the input/output unit 470.

It will be understood by one of ordinary skill in the art that the camera 462 may be omitted according to the performance and the structure of the display apparatus 400*b*.

The light receiver 463 may receive a light signal (including a control signal) received from an external control apparatus (not shown) through a light window (not shown) in a bezel of the display 415. The light receiver 463 may receive a light signal corresponding to a user input (e.g., a touch, a push, a touch gesture, voice, or a motion). The control signal may be extracted from the received light signal under control of the controller 480.

It will be understood by one of ordinary skill in the art that the light receiver 463 may be omitted according to the performance and the structure of the display apparatus 400*b*.

The input/output interface 470 may receive video (e.g., a moving image, etc.), audio (e.g., voice, music, etc.), additional information (e.g., an EPG), etc. from the outside of the display apparatus 400*b* under control of the controller 480. The input/output interface 470 may include at least one of an HDMI port 471, a component jack 472, a PC port 473, and a USB port 474. The input/output interface 170 may further include at least one of a D-sub port, a digital visual interface (DVI) port, ad a DP port according to an implementation example.

It will be understood by one of ordinary skill in the art that the input/output interface 470 may be configured and operate in various ways according to embodiments.

The controller 480 may control an overall operation of the display apparatus 400*b* and a signal flow between the elements 410 through 490 of the display apparatus 400*b* and process data.

The controller 480 may include the controller 20 described with reference to FIG. 2. According to an example embodiment, the controller 480 may determine that a light emitting element having a longest collected light emitting time among light emitting elements does not emit light. The controller 480 may determine that a previously determined number of light emitting elements emit light in high priority order in light emitting element groups. Redundant descriptions between the controller 480 of FIG. 4 and the controller 2 described with reference to FIG. 2 are omitted.

When a user input exists or a preset and stored condition is satisfied, the controller 480 may execute an OS and various applications that are stored in the storage 490.

The controller 480 may include a RAM 481 that stores a signal or data input from the outside of the display apparatus 400*b* or that is used as a storage region correspond to various tasks performed in the display apparatus 400*b*, a ROM 482 that stores a control program for controlling the display apparatus 400*b*, and a processor 483.

The processor 483 may include a graphics processing unit (GPU) (not shown) for performing graphics processing on video. The processor 483 may be implemented as a system-on-chip (SoC) that combines a core (not shown) and the GPU (not shown). The processor 483 may include a single-core, a dual-core, a triple-core, a quad-core, or a multiple core.

The processor 483 may also include a plurality of processors. For example, the processor 483 may include a main processor (not shown) and a sub-processor that operates in a sleep mode.

A graphic processor 484 may generate a screen including various objects such as an icon, an image, text, etc. by using a calculator (not shown) and a renderer (not shown). Based on the user interaction detected through the detector 460, the calculator may calculate an attribute value such as a coordinate value, a shape, a size, or a color of each object according to a layout of the screen. The renderer may generate the screen having various layouts including the object based the attribute value calculated by the calculator.

The screen generated by the renderer may be displayed within a display area of the display 415.

First through nth interfaces 485-1 through **485-*n* may be connected to various elements described above. One of the first through nth interfaces 485-1 through 485-*n* may be a network interface connected to an external apparatus. The RAM 481, the ROM 482, the processor 483, the graphic processor 484, and the first through nth interfaces 485-1 through 485-*n* may be connected to each other via a bus 486**.

The storage 490 may store various data, programs, or applications for driving and controlling the display apparatus **400*b* under control of the controller 480. The storage 490 may store input/output signals or data corresponding to driving of the video processor 410, the display 415, the audio processor 420, the audio output unit 425, the power supply 430, the communicator 450, the detector 460, and the input/output unit 470**.

The storage 490 according to an example embodiment may store whether each of light emitting elements emits light based on priorities.

The storage 490 may store control programs for controlling the display apparatus **400*b* and the controller 480 and applications initially provided from a manufacturer or downloaded from the outside. More specifically, the storage 490** may store resources such as a JavaScript file, an XML file, etc. used in applications.

The storage 490 may store an OS executed when the display apparatus **400*b* is powered on. The storage 490** may store a GUI related to an application, an object (e.g., an image, text, an icon, a button, etc.) for providing the GUI, user information, a document, databases, or related data.

The term 'storage' according to an example embodiment may include the storage 490, the ROM 482 of the controller 480, the RAM 481 of the controller 480, or a memory card (e.g., a micro secure digital (SD) card or a USB memory (not shown)) mounted in the display apparatus **400*b*. The storage 490** may include a nonvolatile memory, a volatile memory, a hard disk drive (HDD), or a solid-state drive (SSD).

The storage 490 may include a volume control module, a communication control module, a voice recognition module, a motion recognition module, a light reception module, a display control module, an audio control module, an external input control module, a power control module, a power supply control module of an external apparatus that is connected through wireless communication (e.g., Bluetooth), a voice database (DB), or a motion DB that are not shown. The modules and the DBs of the storage 490 that are not shown may be configured as software for the display apparatus **400*b* to perform functions of volume control, communication control, voice recognition, motion recognition, light reception control, audio control, external input control, power control, and display control of controlling a cursor or a scrolled item to be displayed. The controller 480 may perform each function by using the software stored in the storage 490**.

The storage 490 may include a presentation module. The presentation module is a module for configuring a display screen. The presentation module may include a multimedia module for reproducing and outputting multimedia content and an UI rendering module for performing UI and graphics processing. The multimedia module may include a player module, a camcorder module, and a sound processing module. Accordingly, the multimedia module may reproduce a variety of multimedia content and may generate and reproduce an image and a sound. The UI rendering module may include an image composition module that combines images, a coordinate combination module that combines and generates coordinates on a screen on which an image is to be displayed, an X11 module that receives various events from hardware, and a 2D/3D UI toolkit that provides a tool for forming a 2D or 3D UI.

The display apparatus **400*b* may be electrically connected to a separate external apparatus (e.g., a set-top box (not shown)) having a tuner. For example, the display apparatus 400*b* may be implemented as an analog TV, a digital TV, a 3D TV, a smart TV, an LED TV, an OLED TV, a plasma TV, a monitor, etc. but it will be understood by one of ordinary skill in the art that the display apparatus 400*b*** is not limited thereto.

The display apparatus **400*b* may further include a sensor (e.g., an illumination sensor, a temperature sensor, a light sensor, etc. (not shown)) that detects an internal or external state of the display apparatus 400*b*. According to an example embodiment, the light sensor may sense an amount of light around the display apparatus 400*b***.

At least one element may be added to or omitted from the elements (e.g., 410 through 490) of the display apparatus **400*b* of FIG. 4 according to a performance of the display apparatus 400*b*. It will be also understood by one of ordinary skill in the art that positions of the elements (e.g., 410 through 490) may vary according to the performance or a structure of the display apparatus 400*b***.

Figure 5:
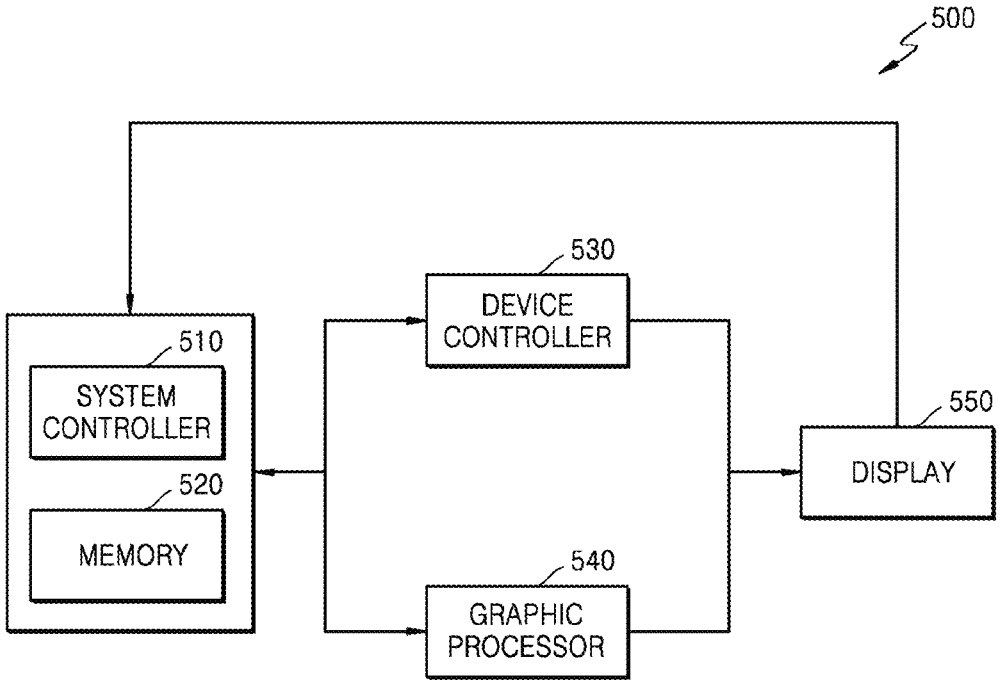
FIG. 5 is a block diagram illustrating an example display apparatus according to another example embodiment.

FIG. 5 is a block diagram illustrating an example display apparatus 500 according to another example embodiment.

Referring to FIG. 5, the display apparatus 500 may include a system controller 510, a memory 520, a device controller 530, a graphic processor 540, and a display 550.

The system controller 510 may control an overall operation and a signal flow between the elements 510 through 550 of the display apparatus 500 and may process data.

The system controller 510 according to an example embodiment may determine whether a light emitting element emits light. More specifically, the system controller 510 according to an example embodiment may determine priorities of light emitting elements included in a light emitting element group based on a collected light emitting time of each of light emitting elements and may determine whether each of light emitting elements emits light based on priorities.

The system controller 510 according to an example embodiment may store information indicating whether each of light emitting elements emits light in the memory 520. More specifically, the memory 520 may store information indicating whether all emitting light devices included in a plurality of light emitting element groups emit light.

The system controller 510 according to an example embodiment may update the collected light emitting time of each of light emitting elements if the information indicating whether each of light emitting elements emits light changes. The collected light emitting time of each of light emitting elements may be stored in the memory 520 or a separate memory of the display apparatus 500.

The system controller 510 according to an example embodiment may control the display 550 to display a screen based on the information indicating whether each of light emitting elements emits light, which is stored in the memory 520.

More specifically, the system controller 510 according to an example embodiment may control the device controller 530 or the graphic processor 540 based on whether each of light emitting elements emits light.

The device control 530 may directly control whether each of light emitting elements of the display 550 emits light based on the information indicating whether each of light emitting elements emits light, which is stored in the memory 520. The device controller 530 may include a display driver IC including an integrated circuit for driving the display 550.

According to an example embodiment, there may be a case where the system controller 510 may not control the device controller 530. For example, the system controller 510 may not control the device controller 530 for directly controlling each of light emitting elements of the display 550. In this regard, the system controller 510 may control an alpha image and output image data to be composited through the graphic processor 540.

The graphic processor 540 may composite the alpha image and the output image data.

More specifically, the graphic processor 540 may generate the alpha image based on the information indicating whether each of light emitting elements emits light, which is stored in the memory 520 and may composite the generated alpha image and the output image data. Meanwhile, the display apparatus 500 may store the output image data in a frame buffer (not shown). The frame buffer may be a separate memory included in the display apparatus 500 that temporally stores image data that are to appear on the screen of the display 550.

The display 550 may display an image under control of the device controller 530 or the graphic processor 540.

The display 550 according to embodiment may include one or more light emitting element groups. Each light emitting element group may include a previously determined number of light emitting devices. A display panel included in the display 550 according to an example embodiment may be implemented as an OLED and a QLED.

Figure 6A:
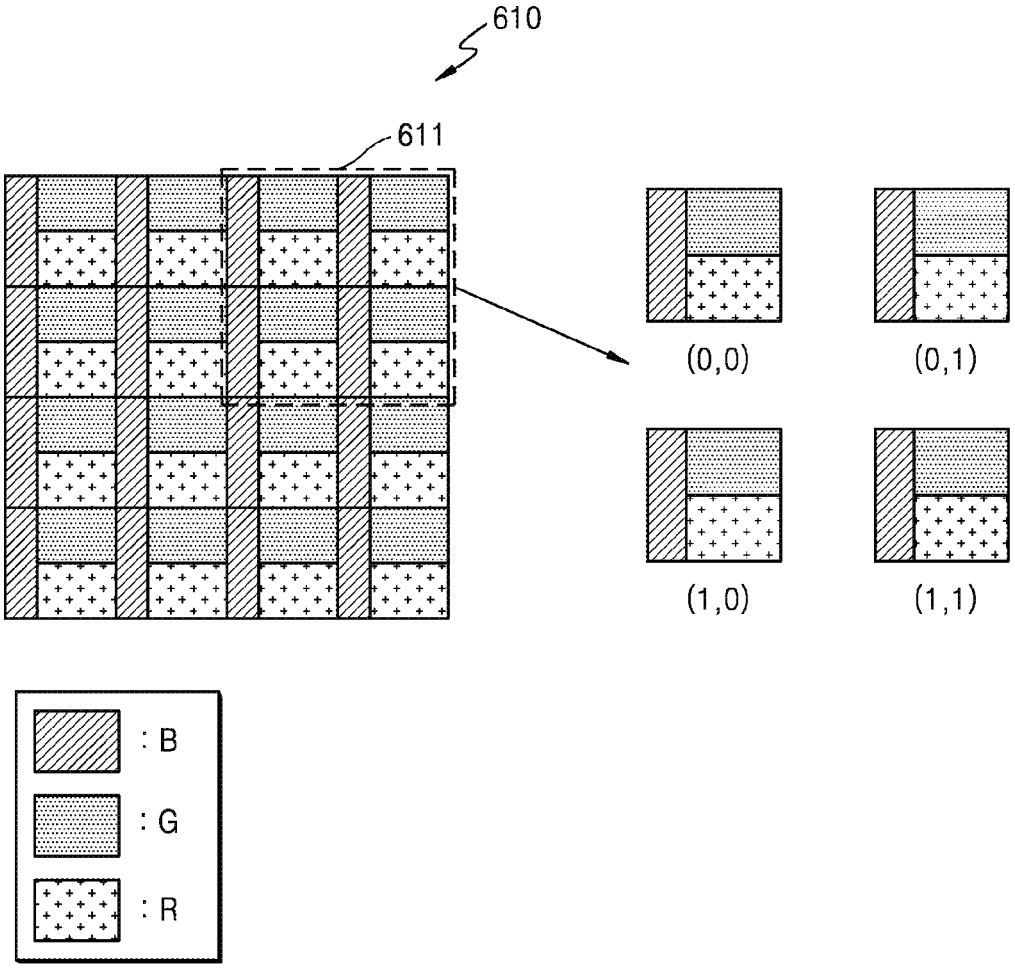
FIG. 6A is a diagram illustrating an example light emitting element group according to an example embodiment.

FIG. 6A is a diagram illustrating an example light emitting element group 611 according to an example embodiment.

FIG. 6A illustrates one 610 of a plurality of light emitting element groups included in a display.

The light emitting element group 611 according to an example embodiment may include four light emitting devices. The light emitting elements may have a rectangular shape. Each light emitting element may include devices that may indicate three colors of red (R), green (G), and blue (B).

Each of the light emitting elements included in the light emitting element group 611 according to an example embodiment may have the same layout of the R, G, and B devices. That is, the light emitting elements located at (0,0), (0,1), (1,0), and (1,1) included in the light emitting element group 611 may have the same layout of the R, G, and B devices.

The light emitting elements included in the light emitting element group 611 may combine light that emit in the R, G, and B devices at a specific ratio to form colors.

Figure 6B:
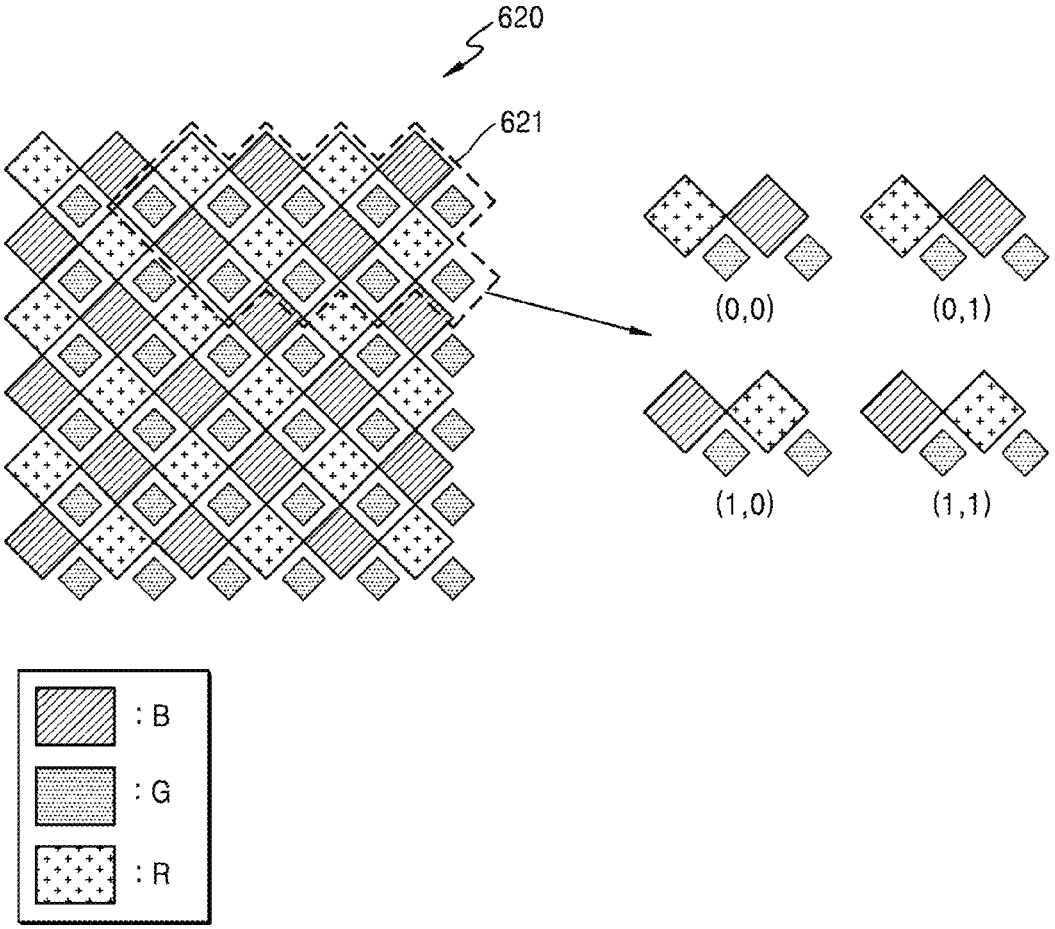
FIG. 6B is a diagram illustrating an example light emitting element group according to another example embodiment.

FIG. 6B is a diagram illustrating an example light emitting element group 621 according to another example embodiment.

FIG. 6B illustrates one 620 of a plurality of light emitting element groups included in a display.

The light emitting element group 621 according to an example embodiment may include four light emitting devices. Each light emitting element may include devices that may indicate three colors of red (R), green (G), and blue (B).

Each of the light emitting elements included in the light emitting element group 631 according to an example embodiment may include a layout of different R, G, and B devices. That is, the light emitting elements located at (0,0) and (0,1) and the light emitting elements located at (1,0) and (1,1) included in the light emitting element group 621 may have different layouts of the R, G, and B devices.

The light emitting elements included in the light emitting element group 621 may combine light that emit in the R, G, and B devices at a specific ratio to form colors.

The layouts of the light emitting elements according to an example embodiment shown in FIGS. 6A and 6B are examples and may vary.

FIGS. 7A through 7E illustrate images displayed by the display apparatus 100 according to an example embodiment.

More specifically, FIGS. 7A through 7E are diagrams illustrating example displayed images and locations of light emitting elements that emit light in a light emitting element group since the display apparatus 100 according to an example embodiment differentiates the number of light emitting elements that emit light.

It is assumed in FIGS. 7A through 7E that each of the light emitting elements of the display apparatus 100 emits light at the same brightness.

Figures 7A, 7B, 7C, 7D, 7E:
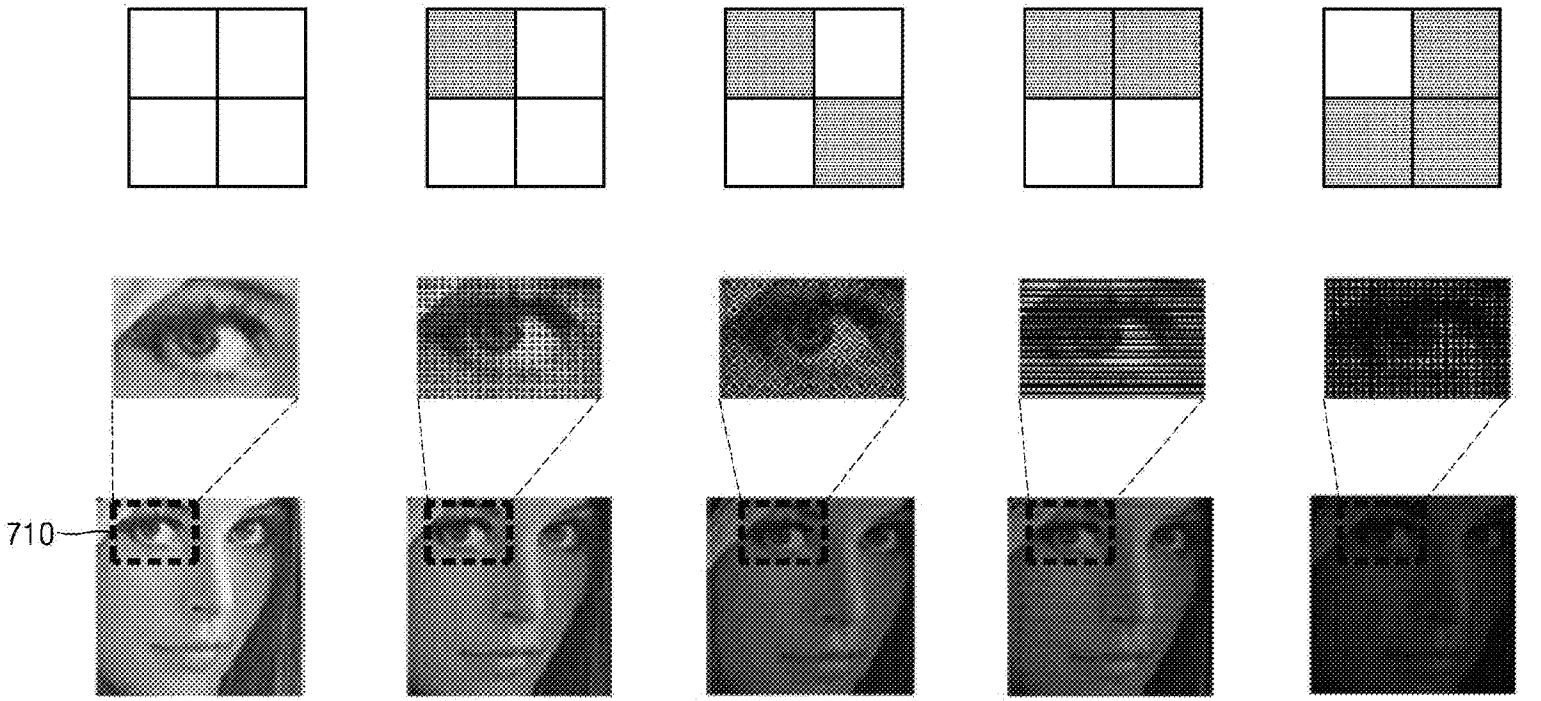
FIGS. 7A through 7E are diagrams illustrating example images displayed by a display apparatus according to an example embodiment.

FIG. 7A illustrates a case where the display apparatus 100 emits light of all the light emitting elements included in the light emitting element group. FIG. 7B shows a case where the display apparatus 100 emits light of three light emitting elements included in the light emitting element group. FIGS. 7C and 7D show cases where the display apparatus 100 emits light of two light emitting elements included in the light emitting element group. FIG. 7E shows a case where the display apparatus 100 emits light of one light emitting element included in the light emitting element group.

Referring to FIG. 7A, the display apparatus 100 may display an image 700*a* at the highest brightness. Referring to FIG. 7B, the display apparatus 100 may display an image 700*b* at 75% of the highest brightness. Referring to FIGS. 7C and 7D, the display apparatus 100 may display images 700*c* and 700*d* at 50% of the highest brightness. Referring to FIG. 7E, the display apparatus 100 may display an image 700*e* at 25% of the highest brightness.

Upon reviewing brightness of all the images 700*a*, 700*b*, 700*c*, 700*d*, and 700*e* in FIGS. 7A through 7E, the brightness of all the images 700*a*, 700*b*, 700*c*, 700*d*, and 700*e* may be changed in proportion to the number of light emitting elements that emit light in light emitting element groups. Accordingly, the light emitting elements of the display apparatus 100 may consume the greatest power in the case of FIG. 7A, and the light emitting elements of the display apparatus 100 may consume the smallest power in the case of FIG. 7E.

In the cases of FIGS. 7A through 7E, upon reviewing resolution of a region 710 of each of images displayed by the display apparatus 100 by enlarging the region 710, the resolution deteriorates as the number of light emitting elements is reduced. More specifically, the image 700*a* of FIG. 7A may have a highest resolution among the images 700*a*, 700*b*, 700*c*, 700*d*, and 700*e* in FIGS. 7A through 7E. The image 700*e* of FIG. 7E may have a lowest resolution and definition among the images 700*a*, 700*b*, 700*c*, 700*d*, and 700*e* in FIGS. 7A through 7E.

Meanwhile, in FIGS. 7C and 7D, locations of the two light emitting elements that emit light in the light emitting element group may be different in the display apparatus 100. In FIGS. 7C and 7D, upon reviewing enlarged regions of the images 700*c* and 700*d*, unlike the image 700*c*, parts of the light emitting elements that do not emit light horizontally may appear in the image 700*d*.

All the images 700*a*, 700*b*, 700*c*, 700*d*, and 700*e* in FIGS. 7A through 7E have the same locations of the light emitting elements that emit light in the plurality of light emitting element groups for convenience of illustration. According to an example embodiment, the display apparatus 100 may differently set locations of the light emitting elements that emit light in the plurality of light emitting element groups.

According to an example embodiment, the display apparatus 100 may set the number of light emitting elements that emit light as a small value when it is determined that high resolution and definition are unnecessary. For example, when a moving image is reproduced and an amount of light is smaller than a previously determined value, the display apparatus 100 may set the number of light emitting elements that emit light in the light emitting element groups as one or two.

According to an example embodiment, the display apparatus 100 may adjust the number and brightness of light emitting elements based on determined priorities.

Figure 8A:
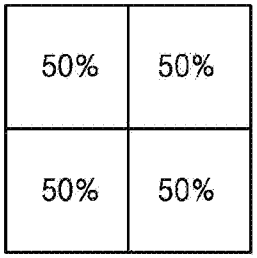
FIGS. 8A through 8C are diagrams illustrating example images displayed, by a display apparatus, at 50% of a highest brightness, according to an example embodiment.
Figure 8A:
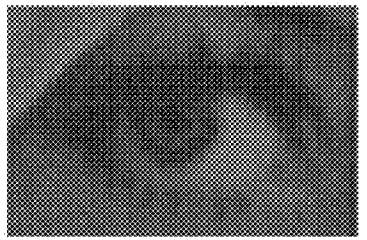
Figure 8B:
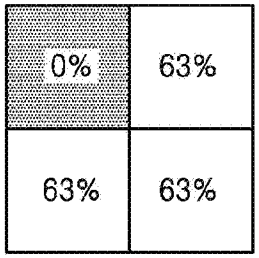
Figure 8B:
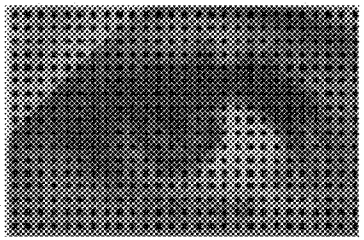
Figure 8C:
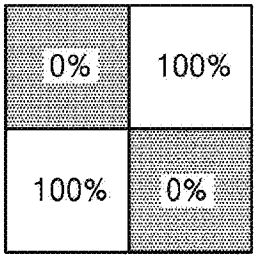
Figure 8C:
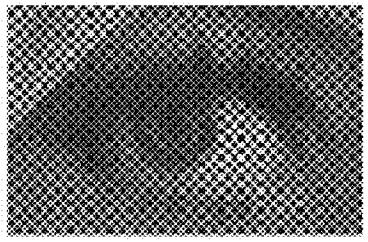

FIGS. 8A through 8C are diagrams illustrating example images displayed, by the display apparatus 100, at 50% of a highest brightness, according to an example embodiment.

Referring to FIGS. 8A through 8C, the display apparatus 100 according to an example embodiment may display different images by adjusting the number and brightness of light emitting elements that emit light.

Meanwhile, it is assumed that all images have the same locations of light emitting elements of light emitting element groups that emit light in FIGS. 8A through 8C.

FIG. 8A illustrates a case where the display apparatus 100 emits light of all the light emitting elements included in the light emitting element groups at 50% of the highest brightness. FIG. 8B illustrates a case where the display apparatus 100 emits light of three light emitting elements included in the light emitting element groups at 63% of the highest brightness. FIG. 8C illustrates a case where the display apparatus 100 emits light of two light emitting elements included in the light emitting element groups at brightness of 100%.

Upon reviewing three cases of FIGS. 8A through 8C, brightness of the light emitting elements of the display apparatus 100 is different, and brightness of all images displayed by the display apparatus 100 is the same as 50% of the highest brightness. That is, the light emitting elements of the display apparatus 100 consume the same amount of power in FIGS. 8A through 8C.

All images displayed by the display apparatus 100 shown in FIGS. 8A through 8C have the same locations of the light emitting elements that emit light in a plurality of light emitting element groups for convenience of illustration. According to an example embodiment, the display apparatus 100 may differently set locations of the light emitting elements that emit light in the plurality of light emitting element groups.

FIGS. 9A through 9D are diagrams illustrating example images displayed, by the display apparatus 100, at 25% of a highest brightness, according to an example embodiment.

Referring to FIGS. 9A through 9D, according to an example embodiment, the display apparatus 100 may display different images by adjusting the number and brightness of light emitting elements that emit light.

Meanwhile, it is assumed that all images have the same locations of light emitting elements of light emitting element groups that emit light in FIGS. 9A through 9D.

Figure 9A:
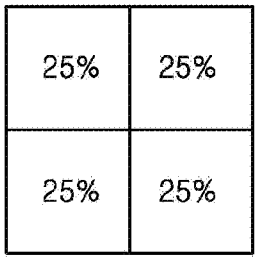
FIGS. 9A through 9D are diagrams illustrating example images displayed, by a display apparatus, at 25% of a highest brightness, according to an example embodiment.
Figure 9A:
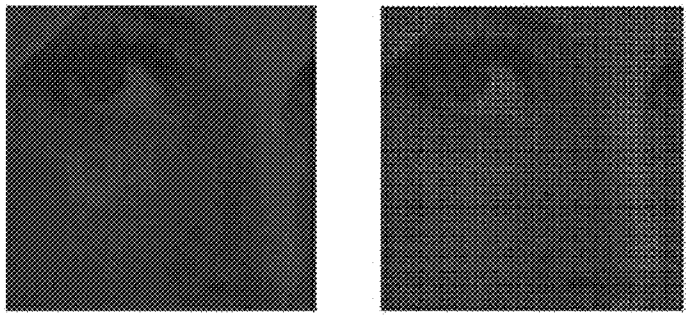
Figure 9B:
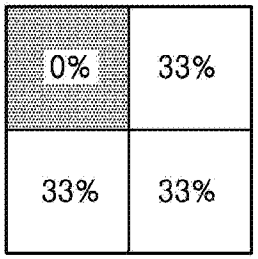
Figure 9C:
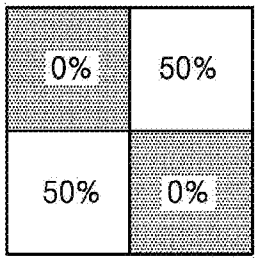
Figure 9C:
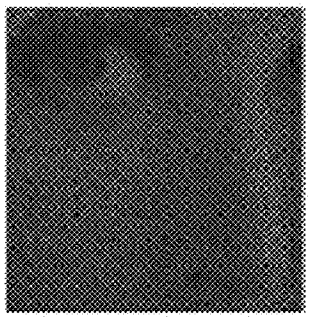
Figure 9D:
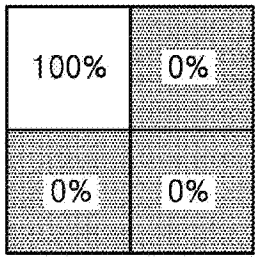
Figure 9D:
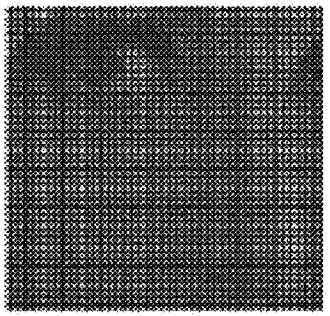

FIG. 9A illustrates a case where the display apparatus 100 emits light of all the light emitting elements included in the light emitting element groups at 25% of the highest brightness. FIG. 9B illustrates a case where the display apparatus 100 emits light of three light emitting elements included in the light emitting element groups at 33% of the highest brightness. FIG. 9C illustrates a case where the display apparatus 100 emits light of two light emitting elements included in the light emitting element groups at 50% of the highest brightness. FIG. 9D illustrates a case where the display apparatus 100 emits light of one light emitting element included in the light emitting element groups at brightness of 100%.

Upon reviewing four cases of FIGS. 9A through 9D, brightness of the light emitting elements of the display apparatus 100 is different, and brightness of all images displayed by the display apparatus 100 is the same as 25% of the highest brightness. That is, the light emitting elements of the display apparatus 100 consume the same amount of power in FIGS. 9A through 9D.

All images displayed by the display apparatus 100 shown in FIGS. 9A through 9D have the same locations of the light emitting elements that emit light in a plurality of light emitting element groups for convenience of illustration. According to an example embodiment, the display apparatus 100 may differently set locations of the light emitting elements that emit light in the plurality of light emitting element groups.

According to the example embodiments illustrated in FIGS. 8A through 9D, the display apparatus 100 may determine the number of light emitting elements that emit light based on a required resolution and an amount of light around the display apparatus 100.

For example, when the amount of light around the display apparatus 100 is smaller than a previously determined value, the display device 100 may determine that all the light emitting elements emit light as illustrated in FIGS. 8A and 9A. The display apparatus 100 may adjust brightness of all the light emitting elements to be the same. In this regard, the display apparatus 100 may reproduce an image having a high resolution.

As another example, when an image that is not required to have a high resolution is reproduced, the display apparatus 100 may determine that some of the light emitting elements emit light as shown in FIGS. 8C and 9D. The display apparatus 100 may adjust brightness of the light emitting elements to be the highest. In this regard, the display apparatus 100 may reproduce an image having the same color sense as that of an original image.

Figure 10:
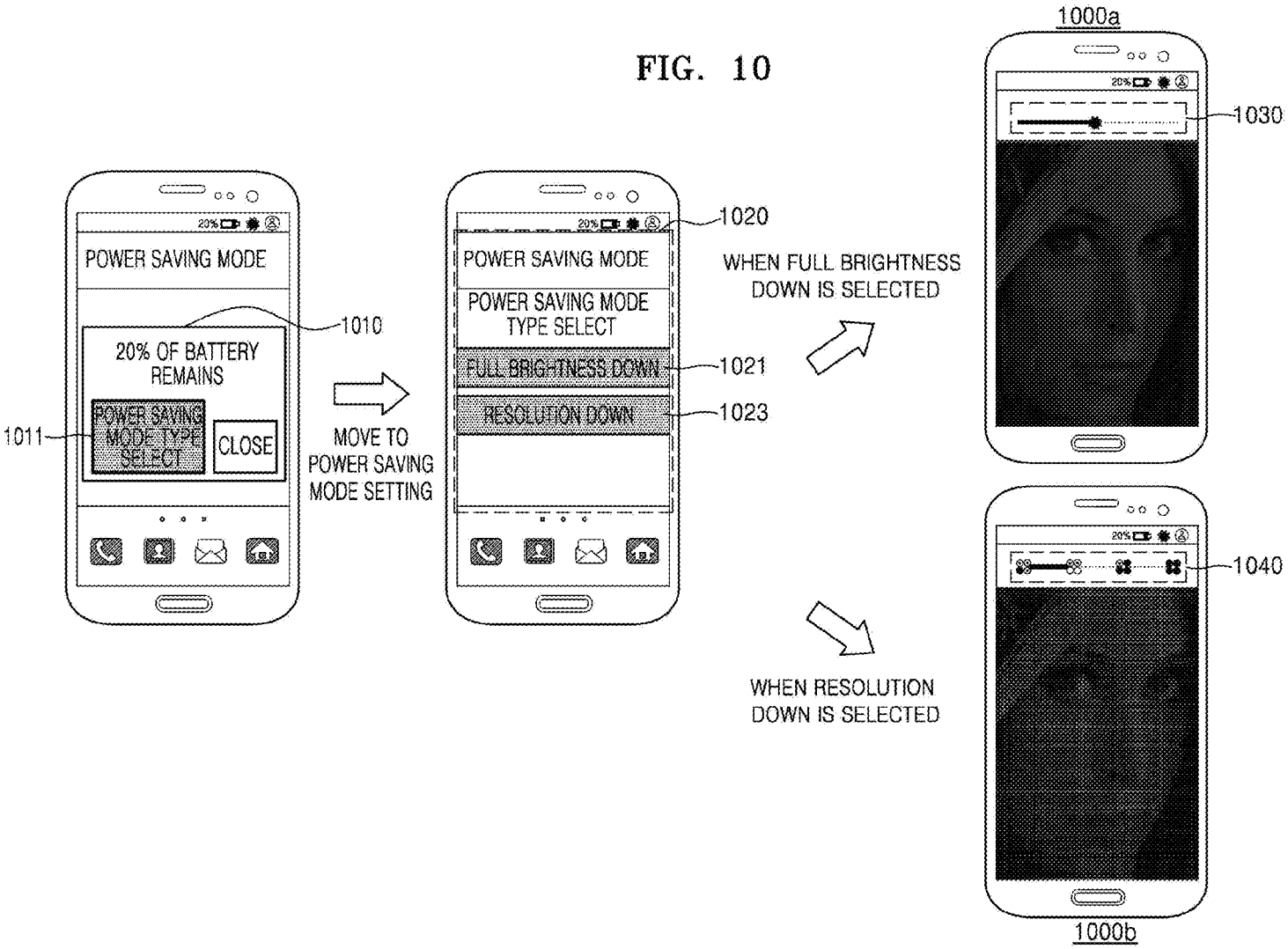
FIG. 10 is a diagram illustrating an example of user interfaces for a display apparatus to select a type of a power saving mode, according to an example embodiment.

FIG. 10 is a diagram illustrating an example of user interfaces 1010, 1020, 1030, and 1040 for the display apparatus 10 to select a type of a power saving mode, according to an example embodiment.

According to an example embodiment, when a remaining quantity of a battery is less than 20%, the display apparatus 100 may display the user interface 1010 including a notification message notifying that there is little remaining quantity of the battery. The display apparatus 100 may display an item 1011 for setting the power saving mode on the user interface 1010. A user may select the item 1011 for setting the power saving mode of the display apparatus 100.

As illustrated in FIG. 10, if the user selects the item 1011, the display apparatus 100 may display the user interface 1020 for setting the power saving mode.

Referring to FIG. 10, the display apparatus 100 may provide the user interface 1020 for selecting one of a full brightness down mode 1021 in which a full brightness of a screen is adjusted and a resolution down mode 1023 in which a resolution is reduced.

In this regard, the full brightness down mode may correspond to a first mode in which all light emitting elements included in a light emitting element group emit light. That is, the display apparatus 100 may change brightness of each light emitting element while allowing all the light emitting elements included in the light emitting element group to emit light in the full brightness down mode. The resolution down mode may correspond to a second mode in which some of the light emitting elements included in the light emitting element group emit light. That is, the display apparatus 100 may turn on some of the light emitting elements included in the light emitting element group in the resolution down mode.

Referring to 1000*a* of FIG. 10, the display apparatus 100 may reduce brightness of the full screen according to an existing power saving mode when the user select the full brightness down mode. In the full brightness down mode, the display apparatus 100 may display the user interface 1030 to allow the user to adjust the brightness of the full screen. In the full brightness down mode, the display apparatus 100 may automatically change the brightness of the full screen based on a remaining quantity of a battery, etc.

Referring to 1000*b* of FIG. 10, the display apparatus 100 may emit light of some of the light emitting elements included in the light emitting element group based on priorities when the user select the resolution down mode. In the resolution down mode, the display apparatus 100 may display the user interface 1040 to allow the user to select the number of light emitting elements that emit light. In the resolution down mode, the display apparatus 100 may select the number of light emitting elements that automatically emit light based on the remaining quantity of a battery, etc.

Figure 11A:
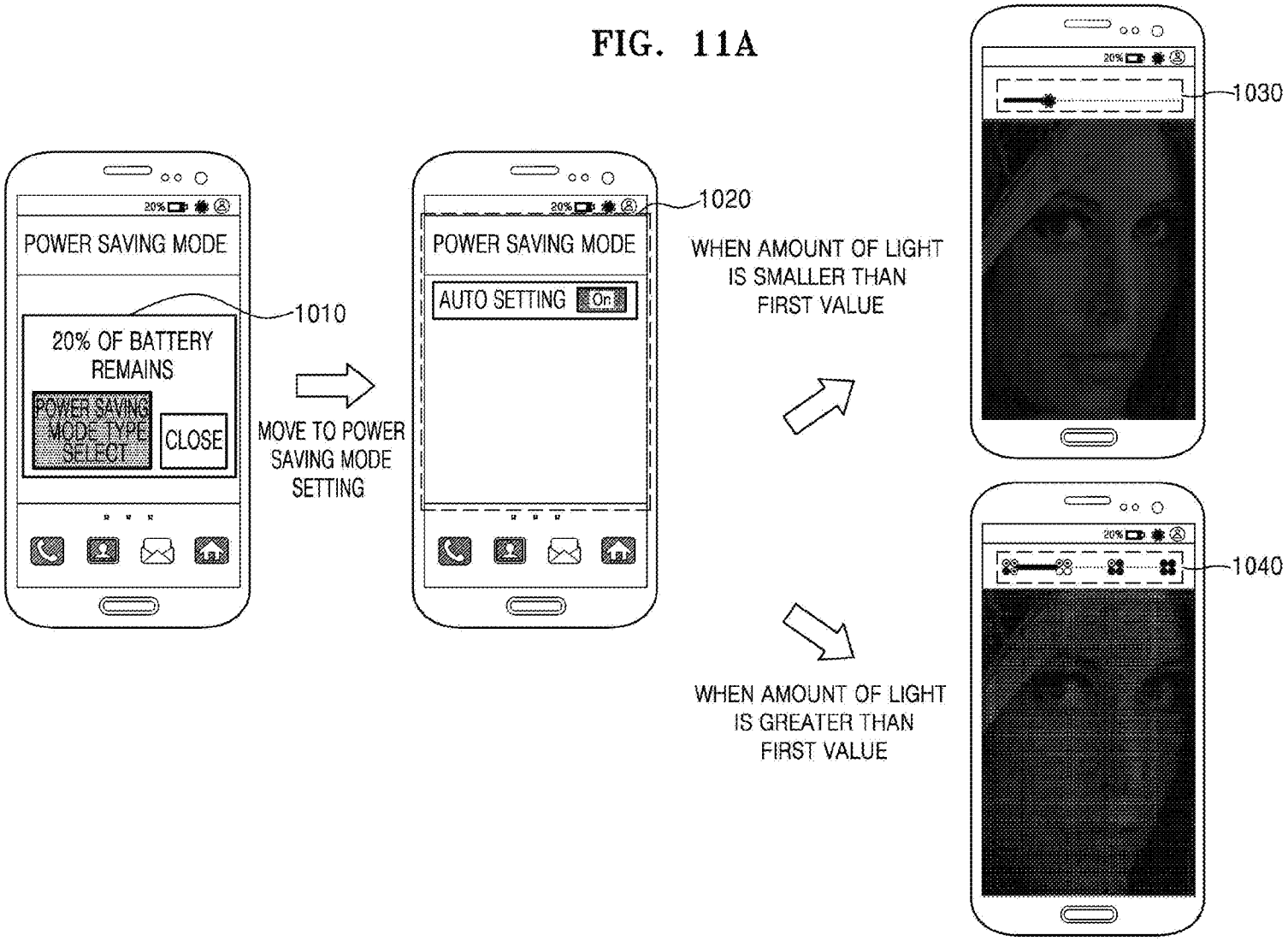
FIG. 11A is a diagram illustrating an example of user interfaces for a display apparatus to automatically set a type of a power saving mode, according to an example embodiment.

FIG. 11A is a diagram for describing providing of the user interfaces 1010, 1020, 1030, and 1040 for the display apparatus 100 to automatically set a type of a power saving mode, according to an example embodiment.

According to an example embodiment, the display apparatus 100 may display the user interface 1010 including a notification message when, for example, a remaining amount of a battery is less than 20%. A user may select an item included in the user interface 110 of the display apparatus 100. If the user selects the item for setting the power saving mode, the display apparatus 100 may display the user interface 1020 for automatically setting the power saving mode.

The display apparatus 100 according to an example embodiment may automatically set a power saving mode setting as one of a first mode and a second mode.

A light sensor (not shown) included in the display apparatus 100 may sense an amount of light around the display apparatus 100. When an amount of light less than a previously determined value of an amount of light is recognized, the display apparatus 100 according to an example embodiment may select the first mode as the power saving mode. That is, when brightness around the display apparatus 100 is dark, the display apparatus 100 may select the first mode as the power saving mode.

When an amount of light greater than the previously determined value of the amount of light is recognized, the display apparatus 100 according to an example embodiment may select the second mode as the power saving mode. That is, when the brightness around the display apparatus 100 is bright, the display apparatus 100 may select the second mode as the power saving mode.

In the first mode, the display apparatus 100 may display the user interface 1030 to allow the user to adjust brightness of a full screen. In the second mode, the display apparatus 200 may display the user interface 1040 to allow the user to select the number of light emitting elements that emit light in a light emitting element group.

For example, the display apparatus 100 may set the previously determined value of the amount of light as that of light having less than 30% of a highest brightness of a screen of the display apparatus 100. According to an example embodiment, the display apparatus 100 may recognize the amount of light less than a first value. In this case, although brightness of light emitting elements of the display 10 is adjusted as 50% of the highest brightness, the user may identify colors displayed on the display apparatus 100. That is, when the apparatus 100 recognizes the amount of light less than the first value, the display apparatus 100 may adjust the brightness of all the light emitting elements as 50% of the highest brightness according to the first mode.

As another example, the display apparatus 100 may recognize the amount of light greater than the previously determined value of the amount of light. In this case, since the brightness around the display apparatus 100 is relatively bright, if the brightness of the light emitting elements of the display 10 is adjusted less than 50% of the highest brightness, the user may not identify colors displayed on the display apparatus 100. When the apparatus 100 recognizes the amount of light greater than the previously determined value of the amount of light, the display apparatus 100 may control a light emitting state of some of the light emitting elements included in the light emitting element group as an off state according to the second mode.

Figure 11B:
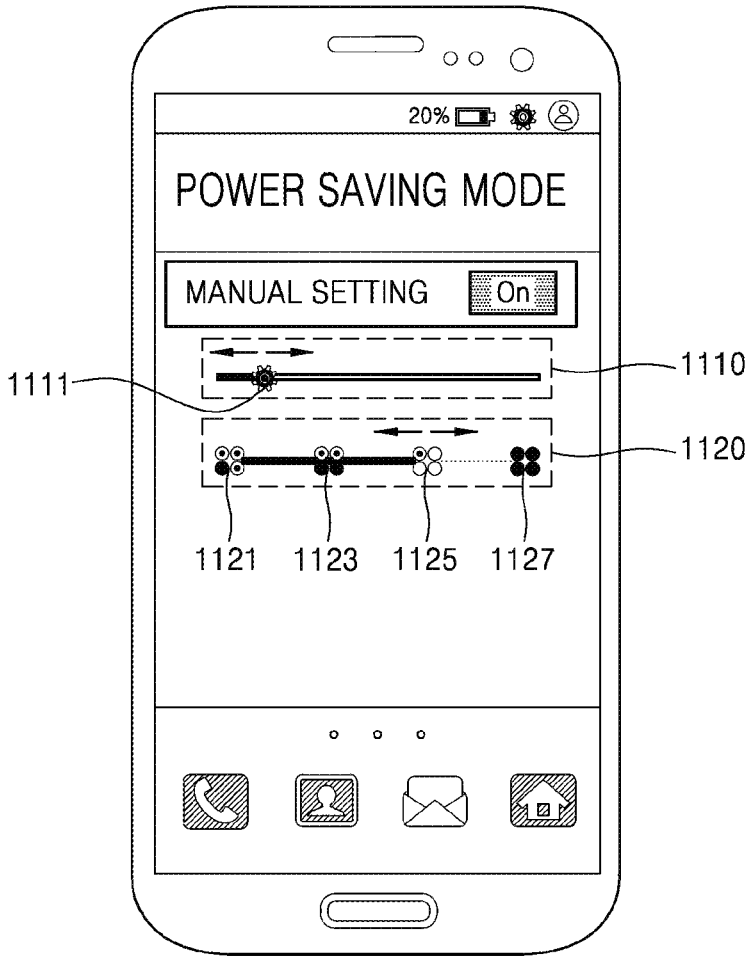
FIG. 11B is a diagram illustrating an example of user interfaces for a display apparatus to manually adjust brightness of a full screen and the number of light emitting elements that emit light in a light emitting element group, according to an example embodiment.

FIG. 11B is a diagram illustrating an example of user interfaces 1110 and 1120 for the display apparatus 100 to manually adjust brightness of a full screen and the number of light emitting elements that emit light in a light emitting element group, according to an example embodiment.

Referring to FIG. 11B, the display apparatus 100 may display the user interface 1110 for adjusting brightness of each of light emitting elements that emit light and the user interface 1120 for selecting the number of light emitting elements that emit light in a light emitting element group.

The user interface 1110 for adjusting brightness of each of light emitting elements of the display apparatus 100 that emit light may include an item 1111 for adjusting brightness of each of light emitting devices. For example, a user may adjust brightness of each of light emitting elements by touching and dragging the item 1111 on a screen of the display apparatus 100.

The user interface 1120 for selecting the number of light emitting elements that emit light in the light emitting element group of the display apparatus 100 may include items 1121, 1123, 1125, and 1127 for adjusting the number of light emitting elements that emit light in the light emitting element group. For example, the user may adjust the number of light emitting elements that emit light in the light emitting element group by touching one of the items 1121, 1123, 1125, and 1127 on the screen of the display apparatus 100. The user may touch a location corresponding to the item 1125 that is currently selected on the user interface 1120 of the display apparatus 100 and then may move the location to a location of one of the items 1121, 1123, 1125, and 1127 on the screen. Accordingly, the user may select the number of light emitting elements corresponding to one of the items 1121, 1123, 1125, and 1127 on the screen.

Figure 12:
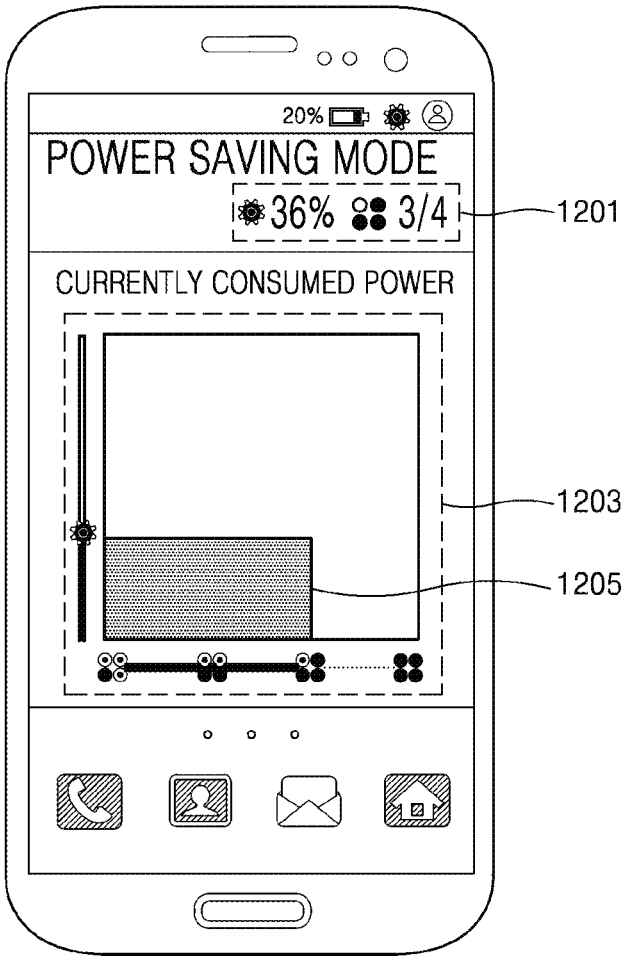
FIG. 12 is a diagram illustrating an example of a user interface displaying power used by a display apparatus, according to an example embodiment.

FIG. 12 is a diagram illustrating an example of a user interface 1203 displaying power used by the display apparatus 100, according to an example embodiment.

The display apparatus 100 may display brightness and the number 1201 of light emitting elements that emit light in a light emitting element group. The display apparatus 100 may display the user interface 1203 indicating an amount of currently consumed power with respect to a greatest amount of consumable power of light emitting elements of the display apparatus 100. An area of a square 1205 displayed on the user interface 1203 displayed on the display apparatus 100 may correspond to the amount of currently consumed power in the light emitting elements of the display apparatus 100.

Figure 13:
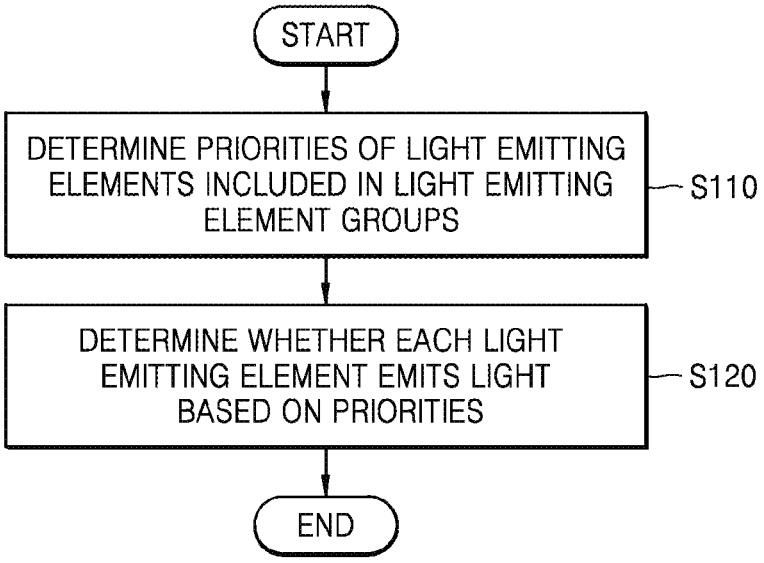
FIG. 13 is a flowchart illustrating an example display method according to an example embodiment.

FIG. 13 is a flowchart illustrating an example display method for the display apparatus 100 according to an example embodiment.

The display apparatus 100 according to an example embodiment may include one of more light emitting element groups. Each light emitting element group may include a previously determined number of light emitting devices.

In operation S110, the display apparatus 100 may determine priorities of the light emitting elements included in the light emitting element groups based on a collected light emitting time of each of the previously determined number of light emitting devices.

For example, the display apparatus 100 may determine a priority of a light emitting element having a shortest collected light emitting time as a highest priority.

In operation S120, the display apparatus 100 may determine whether each light emitting element emits light based on priorities.

For example, the display apparatus 100 may determine that a light emitting element having a highest priority included in the light emitting element groups emits light. The display apparatus 100 may determine that a light emitting element having a lowest priority included in the light emitting element groups does not emit light.

Figure 14:
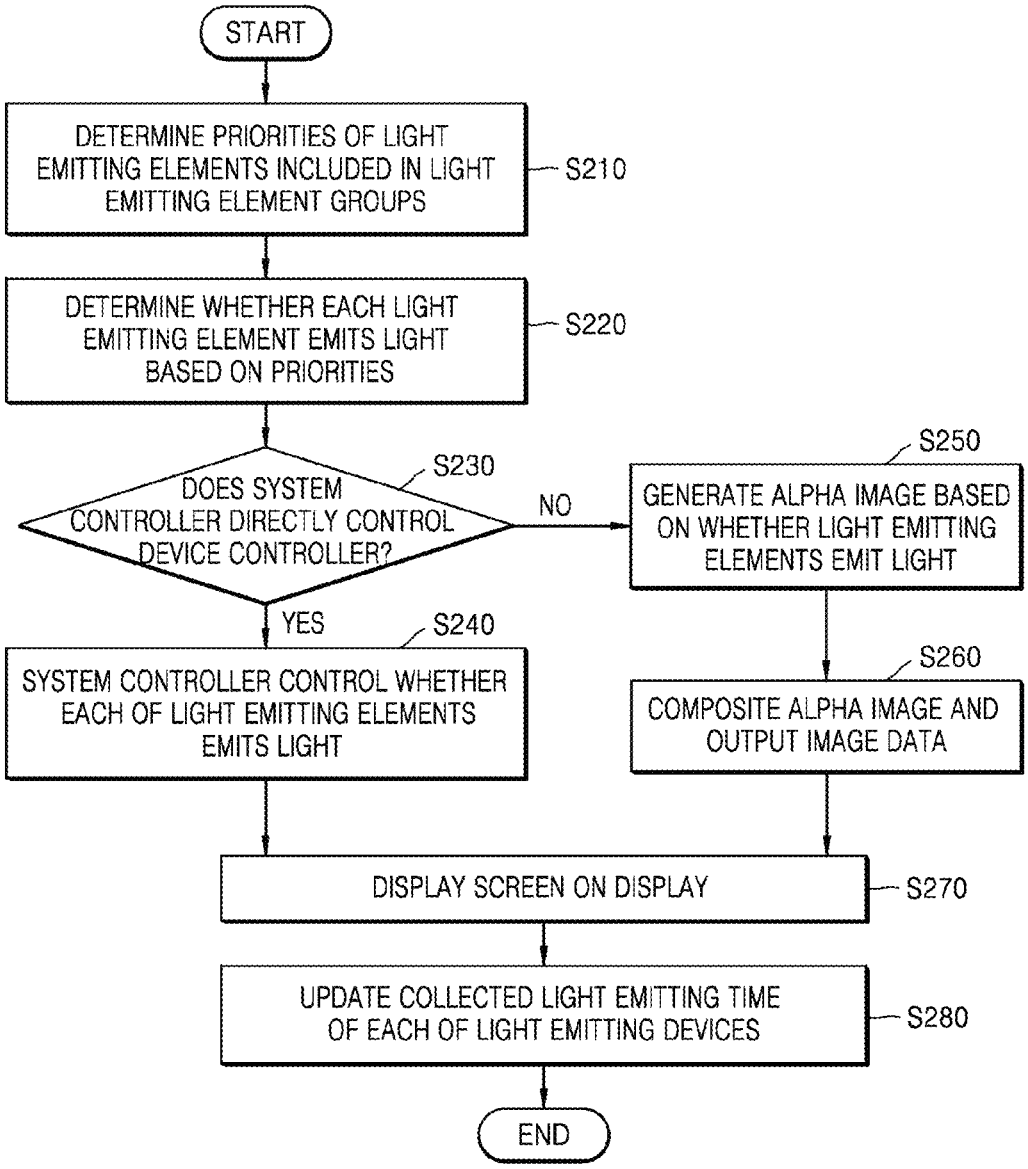
FIG. 14 is a flowchart illustrating an example display method according to another example embodiment.

FIG. 14 is a flowchart illustrating an example display method for the display apparatus 100 according to another example embodiment.

The display apparatus 100 according to an example embodiment may include one of more light emitting element groups. Each light emitting element group may include a previously determined number of light emitting devices.

In operation S210, the display apparatus 100 may determine priorities of the light emitting elements included in the light emitting element groups based on a collected light emitting time of each of the previously determined number of light emitting devices.

In operation S220, the display apparatus 100 may determine whether each light emitting element emits light based on priorities. The display apparatus 100 may store information indicating whether each light emitting element emits light, in a memory included in the display apparatus 100.

In operation S230, the display apparatus 100 may determine whether a system controller included in the display apparatus 100 directly controls a device controller. More specifically, the system controller may control a general operation of the display apparatus 100 and a signal flow between internal elements of the display apparatus 100. The device controller according to an example embodiment may include a display driver IC including an integrated circuit for driving a display.

In operation S230, if the display apparatus 100 determines that the system controller directly controls the device controller, operation S240 may proceed. In operation S240, the system controller of the display apparatus 100 may control whether each of light emitting elements of the display emits light.

More specifically, the system controller of the display apparatus 100 may control the device controller, and the device controller may directly control whether each of the light emitting elements of the display emits light based on whether each light emitting element emits light that is stored in the memory.

In operation S230, if the display apparatus 100 determines that the system controller does not directly control the device controller, operation S250 may proceed. In operation S250, the display apparatus 100 may generate an alpha image based on whether the light emitting elements emit light. The display apparatus 100 may generate the alpha image based on whether each light emitting element emits light that is stored in the memory.

In operation S260, the display apparatus 100 may composite the alpha image and output image data.

The display apparatus 100 may store the output image data in a frame buffer (not shown). The frame buffer may be a separate memory included in the display apparatus 100 capable of temporarily storing image data that is to appear on a screen of the display.

In operation S270, the display apparatus 100 may control the screen to be displayed on the display based on whether each light emitting element group emits light.

In operation S280, if it is changed whether each of the light emitting elements emits light, the display apparatus 100 may update a collected light emitting time of each of the light emitting devices. The display apparatus 100 may store the collected light emitting time of each of the light emitting elements in the memory included in the display apparatus 100.

According to one or more example embodiments, a display apparatus controls light emitting elements to individually emit light or not to emit light, thereby reducing power consumption.

According to one or more example embodiments, a display apparatus also controls some of light emitting elements having a long collected light emitting time not to emit light, thereby increasing an average lifespan of light emitting elements included in the display apparatus.

A display method according to the one or more example embodiments may be implemented as computer instructions which may be executed by various computer means, and recorded on a non-transitory computer-readable recording medium. The non-transitory computer-readable recording medium may include program commands, data files, data structures, or a combination thereof. The program commands recorded on the non-transitory computer-readable recording medium may be specially designed and constructed for the disclosure or may be known to and usable by one of ordinary skill in a field of computer software. Examples of the non-transitory computer-readable medium include storage media such as magnetic media (e.g., hard discs, floppy discs, or magnetic tapes), optical media (e.g., compact disc-read only memories (CD-ROMs), or digital versatile discs (DVDs)), magneto-optical media (e.g., floptical discs), and hardware devices that are specially configured to store and carry out program commands (e.g., ROMs, RAMs, or flash memories). Examples of the program commands include a high-level language code that may be executed by a computer using an interpreter as well as a machine language code made by a compiler.

While the disclosure has been particularly shown and described with reference to example embodiments thereof using specific terms, the embodiments and terms have merely been used to explain the disclosure and should not be construed as limiting the scope of the disclosure as defined by the claims. The embodiments should be considered in a descriptive sense only and not for purposes of limitation. Therefore, the scope of the disclosure is defined not by the detailed description of the disclosure but by the appended claims, and all differences within the scope will be construed as being included in the disclosure.

What is claimed is:

1. A display apparatus comprising:

a display comprising one or more light emitting element groups each group comprising a predetermined number of light emitting devices; and a controller configured to:

determine priorities of the light emitting elements included in the one or more light emitting element groups based on a previous light emitting time of each of the light emitting elements, and based on the priorities of the light emitting elements, determine whether each of the light emitting elements is to be on or off at a given point, wherein the controller is further configured to prioritize so that a light emitting element having a longest collected light emitting time among the light emitting elements of the group does not emit light at the given point in time when other light emitting elements of the group emit light.

2. The display apparatus of claim 1, wherein the controller is further configured to determine, based on the priorities, the number and brightness of the light emitting elements that emit light.

3. The display apparatus of claim 1, wherein the controller is further configured to change whether each of the light emitting elements emits light when content displayed on the display is changed.

4. The display apparatus of claim 1, further comprising: a memory configured to store the collected light emitting time of each of the light emitting devices, wherein the controller is further configured to update the collected light emitting time of each of the light emitting elements based on a change in whether each of the light emitting elements emits light.

5. The display apparatus of claim 1, wherein the display is further configured to display a user interface for selecting one or more of the number and brightness of the light emitting elements included in the one or more light emitting element groups that emit light.

6. The display apparatus of claim 1, further comprising: a light sensor configured to sense an amount of light, wherein the controller is further configured to select one of a first mode in which all the light emitting elements emit light and a second mode in which not all of the light emitting elements emit light, based on the amount of light sensed by the light sensor.

7. The display apparatus of claim 6, wherein the controller is further configured to select the first mode when the light sensor senses that the amount of light is less than a preset amount of light.

8. The display apparatus of claim 6, wherein the controller is further configured to select the second mode when the light sensor senses that the amount of light is greater than a preset amount of light.

9. The display apparatus of claim 1, wherein the controller is further configured to determine whether each of the light emitting elements emits light in a same way when a screen displayed on the display comprises text.

10. The display apparatus of claim 1, wherein the controller is further configured to composite an alpha image and output image data based on whether each of the light emitting elements emit light.

11. A display method performed by a display apparatus comprising a display comprising one or more light emitting element groups each group comprising a predetermined number of light emitting devices, the display method comprising:

determining priorities of the light emitting elements included in the one or more light emitting element groups based on a previous light emitting time of each of the determined number of light emitting devices; and based on the priorities of the light emitting elements, determining whether each of the light emitting elements is to be on or off at a given point, wherein the determining priorities comprises prioritizing so that a light emitting element having a longest collected light emitting time among the light emitting elements of the group does not emit light at the given point in time when other light emitting elements of the group emit light.

12. The method of claim 11, wherein the determining comprises: determining, based on the priorities, the number and brightness of the light emitting elements that emit light.

13. The method of claim 11, further comprising changing whether each of the light emitting elements emits light when content displayed on the display is changed.

14. The method of claim 11, further comprising: updating the collected light emitting time of each of the light emitting elements based on a change in whether each of the light emitting elements emits light.

15. The display method of claim 11, further comprising: displaying a user interface for selecting at least one of the number and brightness of the light emitting elements included in the one or more light emitting element groups that emit light.

16. The display method of claim 11, further comprising: selecting one of a first mode, in which all the light emitting elements emit light and a second mode in which not all of the light emitting elements emit light, based on an amount of light sensed by a light sensor.

17. The display method of claim 16, further comprising: selecting the first mode when the light sensor senses that the amount of light is less than a preset amount of light.

18. The display method of claim 16, further comprising: selecting the second mode when the light sensor senses that the amount of light is greater than a preset amount of light.

* * * * *